US007095966B2

(12) United States Patent
Adachi

(10) Patent No.: US 7,095,966 B2
(45) Date of Patent: Aug. 22, 2006

(54) IMAGE FORMING APPARATUS AND UNIT, AND STORAGE MEDIUM MOUNTED IN THE UNIT

(75) Inventor: Motoki Adachi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/896,898

(22) Filed: Jul. 23, 2004

(65) Prior Publication Data

US 2005/0025506 A1 Feb. 3, 2005

(30) Foreign Application Priority Data

Jul. 31, 2003 (JP) ..... 2003-204820
Jul. 14, 2004 (JP) ..... 2004-207605

(51) Int. Cl.
*G03G 15/08* (2006.01)

(52) U.S. Cl. ..... 399/27; 399/257

(58) Field of Classification Search ..... 399/24, 399/25, 27, 30, 58, 59, 61, 62–64, 29, 129, 399/257
See application file for complete search history.

(56) References Cited

U.S. PATENT DOCUMENTS 6,792,218 B1 * 9/2004 Tungate et al. ..... 399/29

* cited by examiner

*Primary Examiner*—Hoang Ngo
(74) *Attorney, Agent, or Firm*—Fitzpatrick, Cella, Harper & Scinto

(57) ABSTRACT

An image forming apparatus which forms an image by using a unit having at least a member associated with image formation and storage unit storing information, comprising, an image carrier, developing unit for developing a latent image formed on said image carrier by supplying toner to said image carrier and controller for controlling image formation operation on the basis of the information stored in said storage unit, wherein said storage unit stores information for controlling toner consumption operation in accordance with a characteristic of the toner, and said controller controls the toner consumption operation on the basis of the information stored in said storage unit without printing any image on a print medium.

17 Claims, 16 Drawing Sheets

IMAGE FORMING APPARATUS AND UNIT, AND STORAGE MEDIUM MOUNTED IN THE UNIT

FIELD OF THE INVENTION

The present invention relates to an electrophotographic or electrostatic printing image forming apparatus such as a copying machine or printer and, more particularly, to a developing device.

BACKGROUND OF THE INVENTION

FIG. 5 is a sectional view showing an example of a conventional image forming apparatus. In FIG. 5, the electrophotographic image forming apparatus has a freely rotatable photosensitive drum 1 serving as an image carrier. The photosensitive drum 1 is uniformly charged by a primary charger 2, and exposed to an information signal by a light-emitting element 3 such as a laser to form an electrostatic latent image. The electrostatic latent image is visualized into a toner image by a developing device 4. The toner image is transferred by a transfer charger 9 onto a transfer paper sheet 14 conveyed by a transfer sheet convey sheet. The toner image is then fixed by a fixing device 11 to obtain a permanent image. Toner left on the photosensitive drum 1 after transfer is removed by a cleaning device 8.

In the image forming apparatus, the developing device 4 contains toner and carrier serving as a developer. Screws 43 and 44 stir the developer to charge the toner. A development method using such two-component developer causes the following phenomenon. The toner in the developer is consumed by development, replenished from a toner cartridge 5, and replaced by outputting an image. When images (low-coverage-rate images) which hardly consume toner are successively output, toner is replaced only little by little. Toner stays in the developing device for a long time, is rubbed between a blade 42 and a developing sleeve 41 for a long time, and stirred in a developing chamber 47 and stirring chamber 48.

The toner in the developer which is repetitively rubbed and stirred for a long time changes to an irregular shape or suffers offset of the particle diameter distribution. Further, an external additive such as a titanium oxide particle which is added to the developer in order to improve the flowability becomes buried in the toner surface. This results in degradation such as poor flowability of the developer, failing to obtain an image which keeps a desired image quality.

Charges of toner stabilize upon rubbing several times. However, repetitive rubbing gradually charges toner to exceed a predetermined charge amount. As charges of toner increase, the amount of toner attached to a latent image which is formed on the photosensitive drum 1 and is equal in potential difference to the developing sleeve 41 decreases from an initial state. This appears as degradation of the image quality such as low density upon outputting an image or conspicuous graininess at a low-density portion.

As another development method, various dry monocomponent development methods have been proposed and commercially available. One of these methods is impression (contact) development. Impression development has many advantages such as easy simplification and downsizing of the apparatus because this development does not require any magnetic material (carrier). In addition, impression development can form a color image by using nonmagnetic toner.

FIG. 6 shows a developing unit using impression (contact) development. In impression (contact) development, an electrostatic latent image is developed by pressing the surface of a toner carrier against the electrostatic latent image or bringing the surface into contact with the image. As the toner carrier, an elastic, conductive developing roller must be adopted. In order to obtain a known development electrode effect or bias effect, a conductive layer is formed on or near the surface of the developing roller, and a bias voltage can be applied as needed. Toner is charged by triboelectrification between the toner carrier and a developing blade for forming a toner layer.

In the above-described impression (contact) development, the image quality degrades as the number of formed images increases. Degradation of the image quality is mainly caused by toner deterioration, and main causes are rubbing between the developing roller and the surface of the image carrier and rubbing between the developing roller and the developing blade. This phenomenon occurs when toner near the developing roller is hardly consumed and rubbed for a long time. In particular, the phenomenon becomes prominent when many low-coverage-rate images are printed.

To solve these problems, there is proposed a method of forcedly consuming a predetermined amount of toner by development considering the relationship between the number of turns of the developer carrier or the print count and the coverage rate.

As a simple method, a predetermined amount of toner is consumed when the number of turns of the developer carrier reaches a predetermined value. According to this method, however, a predetermined amount of toner is consumed even when a large amount of toner is consumed. Forced toner consumption operation is executed even under conditions in which no problem occurs, wastefully consuming toner. To prevent this, a predetermined amount of toner is consumed only when the toner amount is equal to or smaller than a given threshold (coverage rate) which is calculated from the number of turns of the developer carrier or the print count and the sum of laser exposure amounts for one image of video count data.

The flow of a detailed process is shown in FIG. 3. The number of output images is set (step S301), and when image formation starts (step S302), a CPU 30 loads input image data (step S303), and calculates an image ratio (step S304). After one image is output (steps S305 and S306), whether the image ratio is equal to or smaller than a predetermined value (e.g., 5%) is determined (step S307). If YES in step S307, a predetermined amount of toner is consumed (step S308). A latent image is formed in the entire region along the axial direction of a photosensitive drum at a laser irradiation amount of FFH so as to consume an amount of toner corresponding to a predetermined value (corresponding to an image ratio of 5%). The predetermined amount may be constant or changed depending on the image ratio of an output image. When the predetermined amount is changed, it is preferable to consume an amount of toner corresponding to an image ratio of 5% or more including the image ratio of the output image. After the end of consumption and replenishment of toner, whether the number of output images reaches a designated count is checked (S309). If NO in step S309, the process is repeated from loading of image data (from step S303); if YES, image formation ends (step S310).

This sequence need not always be executed. The sequence is executed only when the print count or the number of turns of the developer carrier reaches a predetermined value. This can reduce the number of forced toner consumption operations.

By the above-described sequence, a predetermined amount of toner is always replaced, and excessive rubbing of the same toner can be prevented. As a result, excessive charging and deterioration of toner are suppressed.

In the conventional scheme described above, the following phenomena occur. The deterioration degree or charged state of toner sometimes greatly changes owing to preparation variations in the developer of toner and carrier or the difference in the characteristic of the regulation blade or developer carrier. When the developing unit is designed as a unit detachable from the image forming apparatus main body, the characteristic of the developer or each part may vary between units. If forced toner consumption operation is executed on the basis of a predetermined threshold or consumption amount, toner is excessively consumed, or an image deteriorates due to insufficient consumption.

SUMMARY OF THE INVENTION

It is an object of the present invention to improve the traditional image forming apparatus. It is also an object of the present invention to prevent excessive toner consumption and image deterioration due to insufficient consumption in forced toner consumption operation by reducing the influence of variations in developer and the characteristics of parts for each unit from which the developing unit is detachable.

An image forming apparatus which forms an image by using a unit having at least a member associated with image formation and storage unit storing information, comprises, an image carrier, developing unit for developing a latent image formed on the image carrier by supplying toner to the image carrier and controller for controlling image formation operation on the basis of the information stored in the storage unit, wherein the storage unit stores information for controlling toner consumption operation in accordance with a characteristic of the toner and the controller controls the toner consumption operation on the basis of the information stored in the storage unit without printing any image on a print medium.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Figure 1:
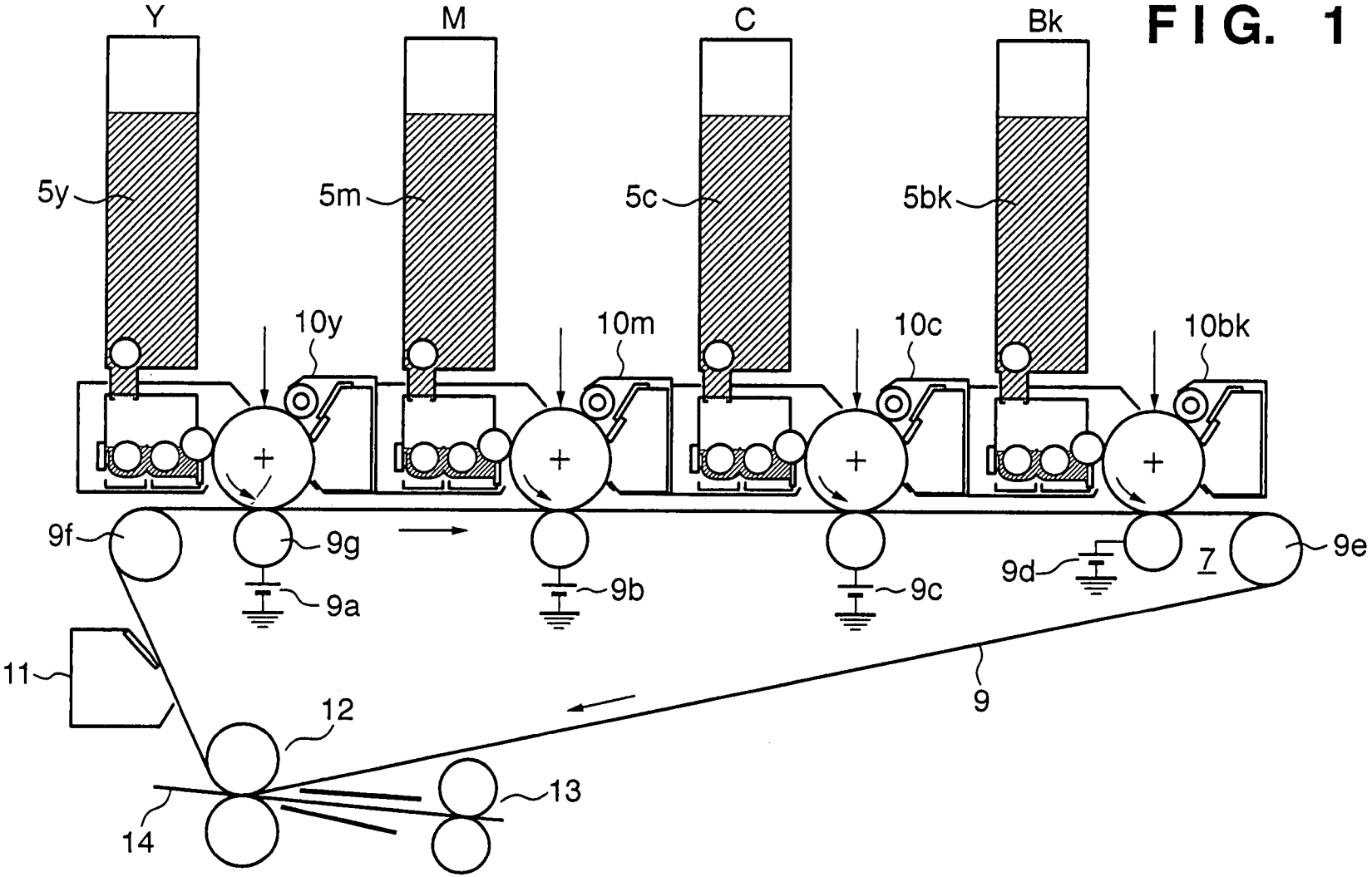
FIG. 1 is a sectional view showing an example of the arrangement of a laser printer according to an embodiment of the present invention.

Preferred embodiments of the present invention will now be described in detail in accordance with the accompanying drawings.

The following embodiments will illustratively explain the present invention, and the sizes, materials, shapes, and relative arrangements of building components to be described later do not limit the scope of the present invention, unless otherwise specified. In the accompanying drawings, the same reference numerals denote building components having the same or similar functions.

First Embodiment

Figure 2:
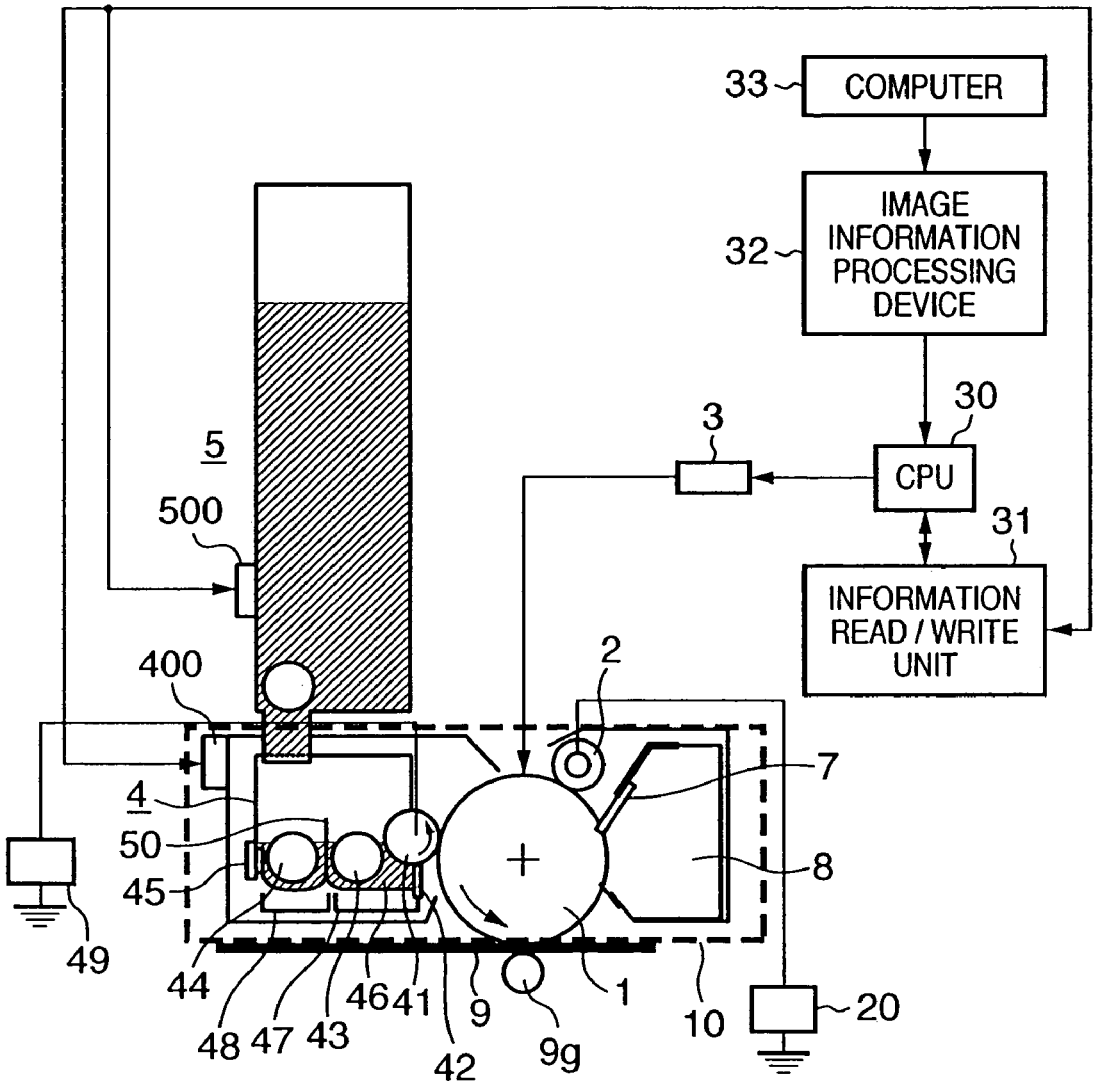
FIG. 2 is a sectional view showing an example of the arrangement of an image forming unit according to the embodiment of the present invention.
Figure 3:
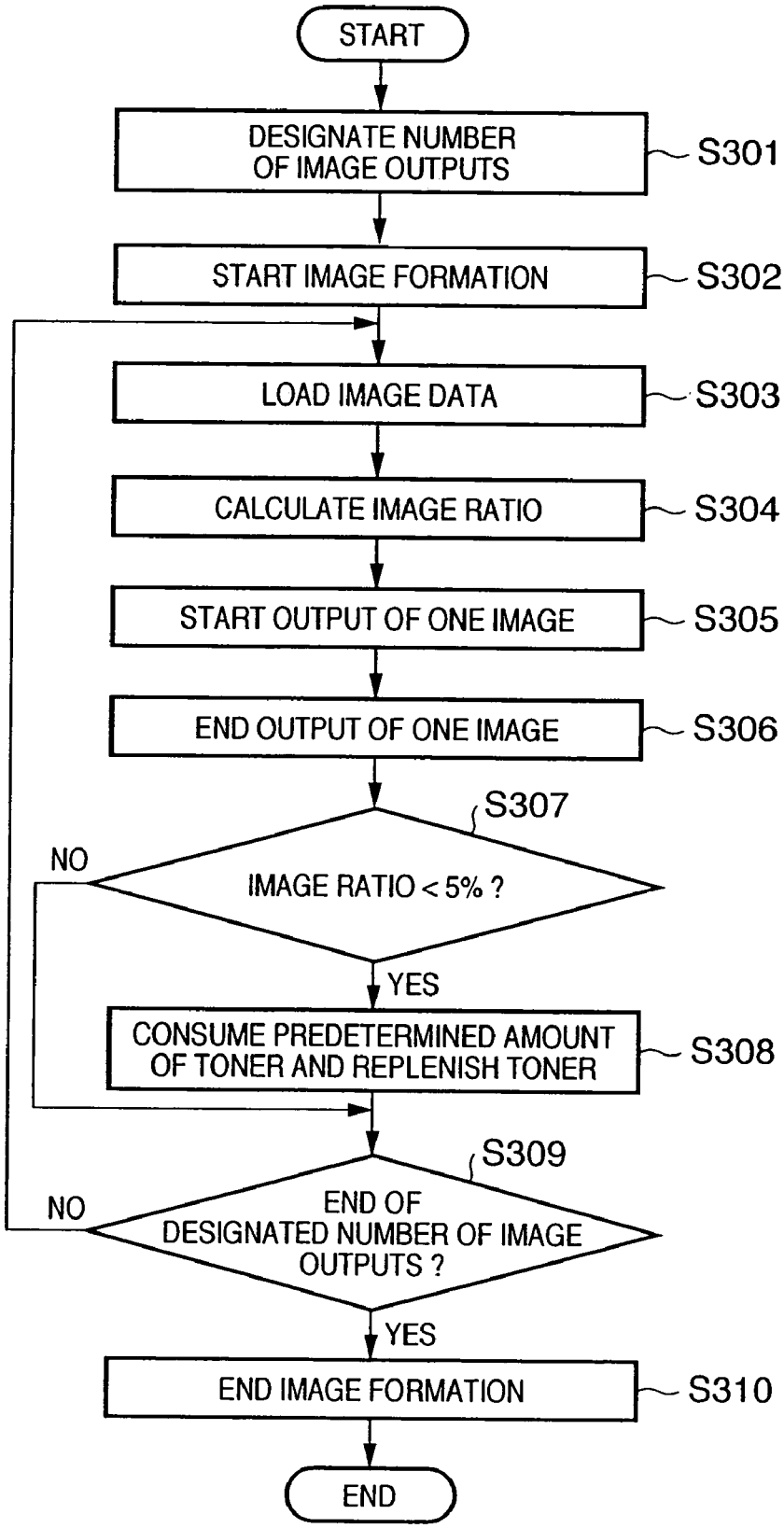
FIG. 3 is a flowchart showing a forced toner consumption process in a conventional image forming apparatus.

The first embodiment of an image forming apparatus according to the present invention will be described in detail with reference to FIGS. 1 and 2. FIG. 1 is a sectional view showing an example of the arrangement of a color laser printer serving as the image forming apparatus according to the first embodiment. FIG. 2 is a sectional view for explaining the arrangement of the image forming unit of one station in the image forming apparatus according to the first embodiment.

The color laser printer as the image forming apparatus shown in FIG. 1 employs contact charging and reversal development utilizing a transfer electrophotographic process at a paper size up to A3. The color laser printer comprises as units a plurality of process cartridges 10 (to be referred to as P-CRGs hereinafter) and a plurality of toner cartridges 5. The color laser printer is a 4-drum (inline) printer which temporarily successively transfers images onto an intermediate transfer belt 9 serving as the second image carrier and thereby obtains a full-color printed image. The first embodiment will exemplify a color laser printer, but the present invention can be applied to a monochrome laser printer.

The endless intermediate transfer belt 9 is suspended between a driving roller 9*e*, a tension roller 9*f*, and a secondary transfer counter roller 12*a*, and rotates in a direction indicated by arrows in FIG. 1. The four process cartridges 10 are arranged in series along the intermediate transfer belt 9 in the order of yellow (10*y*), magenta (10*m*), cyan (10*c*), and black (10*bk*).

Each toner cartridge 5 is arranged above a corresponding process cartridge 10. The toner cartridge 5 and process cartridge 10 have openings at a coupling portion, and when the toner in the process cartridge 10 reduces, a necessary amount of fresh toner is supplied through the openings. The replenishment amount is determined by a CPU (CPU 30 in FIG. 2) on the basis of a signal from a developer concentration detector 45 implemented by an optical or electromagnetic unit.

The image forming apparatus comprises photosensitive drums 1 serving as latent image carriers, charging devices 2 which charge the photosensitive drums 1, exposure devices 3 which form latent images on the photosensitive drums 1, developing devices 4 which visualize electrostatic latent images on the photosensitive drums 1 with toner, the toner cartridges 5 corresponding to the respective developing devices 4, transfer devices 9*g* which transfer visualized toner images from the photosensitive drums 1 onto the transfer medium 9, a fixing device 12 which fixes toner images transferred onto the transfer medium 9, and cleaning devices 8 which remove toner left on the photosensitive drums 1 after transfer.

The image forming process will be explained. An image information signal sent from an output device 33 such as a computer via an image information processing device 32 is received by the CPU 30 of the image forming apparatus. The CPU 30 controls the operation of the image forming apparatus, and also controls laser beam-emitting elements in the exposure devices 3 to emit a laser beam for forming an electrostatic latent image. The photosensitive drums 1 rotate in the counterclockwise direction in FIGS. 1 and 2. The photosensitive drums 1 are charged to a predetermined potential by the charging devices 2 sequentially in the process cartridges. The exposure devices 3 perform an exposure process corresponding to image information to form electrostatic latent images on the photosensitive drums 1.

The electrostatic latent images formed on the photosensitive drums 1 are visualized as toner images by the developing devices 4. The visualized toner images are transferred onto the intermediate transfer belt 9 at predetermined timings. The multiple toner images on the intermediate transfer belt 9 are transferred at once onto a transfer medium 14 such as a paper sheet at the secondary transfer portion. The transfer medium 14 is conveyed to the fixing device 12, and discharged after the toner images are fixed by the fixing device 12. Toner left on the photosensitive drums 1 after transfer is cleaned by the cleaning devices 8. Each cleaning device 8 comprises a cleaning blade 7 serving as a cleaning member, scrapes toner left after transfer from the photosensitive drum 1, and stores the scraped toner in a waste toner vessel.

In the first embodiment, the photosensitive drum 1, charging device 2, developing device 4, and cleaning device 8 are assembled into a unit as the process cartridge 10. The process cartridge 10 is detachable from the main body of an image forming apparatus 200.

The process cartridge 10 is equipped with an information storage medium 400 which stores information on forced toner consumption (to be described later), information on process conditions, and the like. The information storage medium 400 can take an arbitrary form: a contact nonvolatile memory which performs communication by contact via a connector (not shown), contact (not shown), or the like, a noncontact nonvolatile memory which performs communication by electromagnetic waves using a communication member such as an antenna without the intermediacy of any connector, contact, or the like, or a volatile memory having a power supply. The CPU 30 reads out and writes information via an information read/write unit 31 for communicating information with the information storage medium 400 and an information storage medium 500. Forced toner consumption (to be described later) is controlled on the basis of readout information.

Figure 15:
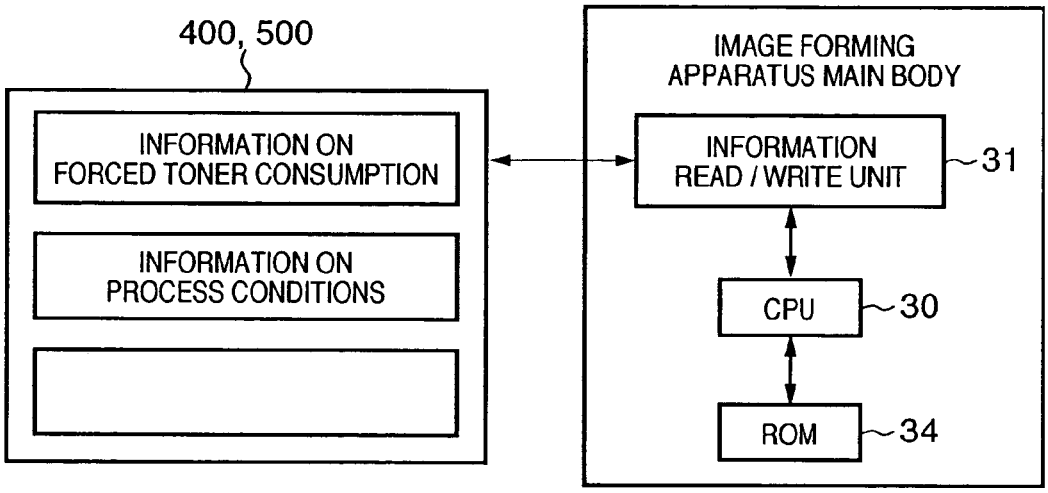
FIG. 15 is a block diagram for explaining the relationship between the image forming apparatus and an information storage medium arranged in a cartridge according to the embodiment of the present invention.

FIG. 15 is a block diagram showing the relationship between the image forming apparatus main body and the information storage medium (400 or 500) serving as a nonvolatile memory arranged in the process cartridge 10 or toner cartridge 5. For example, the information storage medium 400 ensures an area for storing information. Information stored in the storage area of the information storage medium 400 is read out by the information read/write unit 31 arranged in the image forming main body, and is loaded into the main body CPU 30.

The developing device 4 will be described in detail with reference to FIG. 2. The developing device 4 which faces the photosensitive drum 1 has a developing vessel 46, a developing sleeve 41 serving as a developer convey unit, and a blade 42 serving as a tip regulating member for the developer. The interior of the developing device 4 is divided into a developing chamber 47 (first chamber) and a stirring chamber 48 (second chamber) by a vertical partition. The portion above the partition is open. The developing chamber 47 and stirring chamber 48 store a two-component developer containing nonmagnetic toner and magnetic carrier. An unnecessary developer in the developing chamber 47 is recovered to the stirring chamber 48.

The developing chamber 47 and stirring chamber 48 incorporate first and second stirring screws 43 and 44, respectively. The developing chamber 47 in the developing device 4 has an opening at a position corresponding to a developing region facing the photosensitive drum 1. The developing sleeve 41 is rotatably arranged in the opening so as to be partially exposed. The developing sleeve 41 is formed by a nonmagnetic material, and rotates in a direction indicated by an arrow in FIG. 2 in developing operation. A magnet (magnet roller) is fixed as a magnetic field generation unit inside the developing sleeve 41. The developing sleeve 41 carries and conveys a layer of the two-component developer whose layer thickness is regulated by the blade 42. The developer is supplied to the photosensitive drum 1 in the developing region facing the photosensitive drum 1, thus developing a latent image. In order to increase the developing efficiency, a developing bias voltage prepared by superposing, e.g., an AC voltage on a DC voltage is applied from the power supply to the developing sleeve 41.

The magnet roller of the developing device 4 has a pentode arrangement. The developer stirred by the stirring screw of the developing chamber is attracted by the magnetic force of a convey magnetic pole (draw-up pole) N2 for drawing up the developer, and is supplied to a developer reservoir portion 5 by rotation of the developing sleeve 41. In order to attract the developer stably, the developer is satisfactorily attracted by a convey magnetic pole (cut pole) S2 having a predetermined magnetic flux density or more, and conveyed while forming a magnetic brush. The blade 42 serving as a tip regulating member cuts the tip of the magnetic brush to regulate the developer to a proper amount. The resultant developer is supplied by a convey magnetic pole N1.

The developer contains nonmagnetic toner in which a pigment is dispersed in a polyester resin, and magnetic carrier in which ferrite is coated with a silicone resin. Toner is negatively charged by rubbing and stirring in the developing chamber and stirring chamber. Toner is supplied from the toner cartridge by an amount consumed by development. Newly replenished toner is also properly charged by stirring and rubbing.

That is, the toner in the developer is replenished, charged by stirring and rubbing, and sequentially replaced during development. If the amount of toner replacement is small, toner is excessively charged. Long-time stirring and rubbing further deteriorate toner. Toner which is excessively charged or deteriorates becomes low in concentration in development, and causes image deterioration such as nonuniform transfer due to a transfer error.

The first embodiment prevents excessive toner charging and image deterioration by forcedly consuming and replacing toner. Control of forcedly consuming toner is executed in a non-image formation state, for example, in backward rotation or forward rotation or between paper sheets at a timing when normal image formation of printing an image on a print sheet is not performed.

The forced toner consumption process is executed as follows. Similar to image formation, the photosensitive drum 1 is charged by the charging device 2, and exposed in the entire region of the drum 1 in the axial direction by the exposure device 3 for a predetermined time. Similar to image formation, toner is supplied from the developing device 4 to the exposed portion, forcedly consuming toner from the developing vessel 46.

At this time, no voltage is applied to the transfer device 9*g*. Toner forcedly consumed on the photosensitive drum 1 passes through the transfer position without transfer and is removed by the cleaning device 8. A small amount of toner is transferred onto the transfer belt 9, but recovered by a transfer belt cleaner 11.

In the first embodiment, the photosensitive drum 1 is exposed in its entire region in the axial direction at a laser irradiation amount of FFH for high-concentration development. This can increase the toner consumption amount and end forced consumption operation within a short time. However, the laser irradiation amount is not always FFH, and when the operation has enough time, is so set as to efficiently consume toner.

By consuming deteriorated toner, the developing device 4 is newly replenished with fresh toner by a consumed amount from the toner cartridge 5 serving as a toner replenishment bath. Toner in the developing vessel 46 is replaced to attain appropriate toner flowability and charge amount.

The relationship between the image level and the print count corresponding to an aspect of the forced toner consumption process will be explained with reference to FIGS. 8 to 10.

Figure 8:
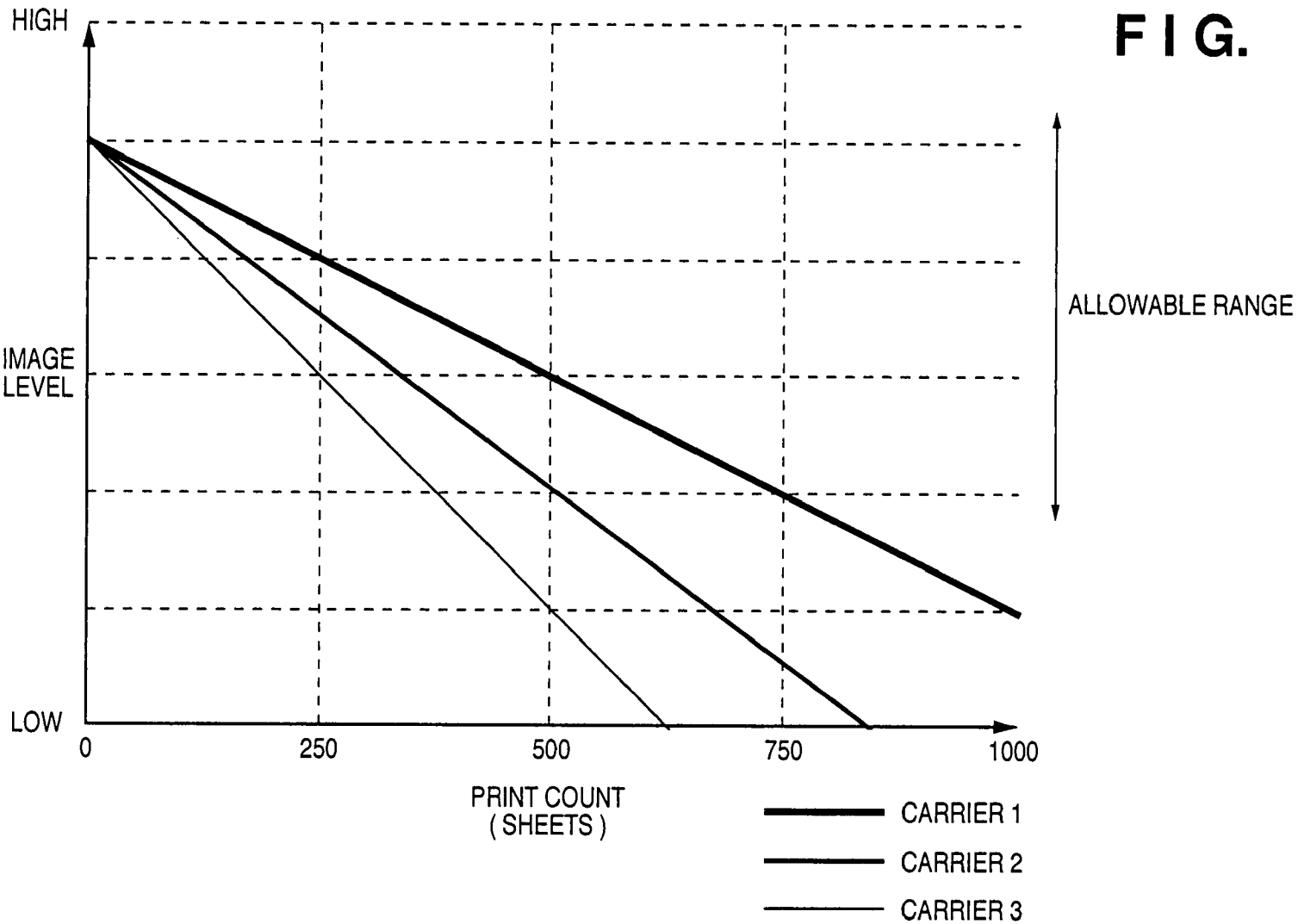
FIG. 8 is a graph showing the relationship between the print count and the image level when a predetermined number of images are successively printed without performing any forced toner consumption process in the first embodiment of the present invention.

FIG. 8 is a graph showing the relationship between the print count and the image level when a predetermined number of images are successively printed without performing any forced toner consumption process at a coverage rate of 0.5%. In the graph of FIG. 8, the abscissa represents the print count, and the ordinate represents the image level. The graph exhibits that the image level drops as the print count increases. In the test, a change in image level with respect to the print count was observed using three carriers 1 to 3.

In FIG. 8, carrier 1 can maintain the allowable range up to 800 images, but carrier 3 can maintain the allowable range only up to 400 images. This is ascribed to variations in carrier characteristic: a given carrier charges toner and another carrier hardly charges toner. This difference appears in the relationship between the coverage rate and a decrease in image quality. Note that the allowable range means the range of an image level allowable as a printed material.

Figure 9:
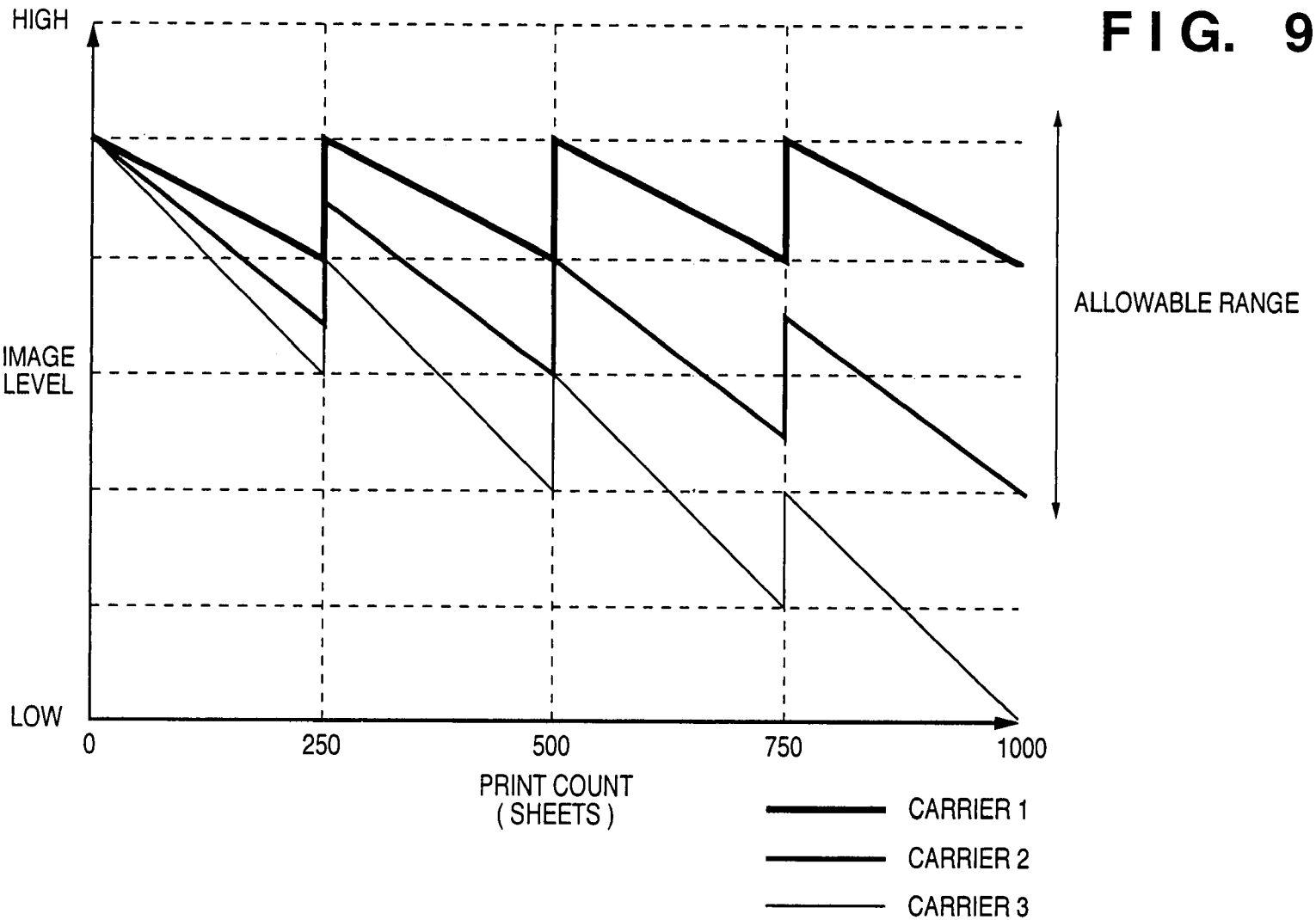
FIG. 9 is a graph showing the relationship between the print count and the image level when forced toner consumption is executed at the same timing by the same amount in the first embodiment of the present invention.

The results of executing forced toner consumption at the same timing by the same amount are shown in FIG. 9. In this case, the threshold of the coverage rate is set to 2.0%, and the timing is set every 250 sheets in accordance with a carrier (carrier 1) which hardly degrades the image quality. FIG. 9 shows the presence of carriers (carriers 2 and 3) with which the image level temporarily recovers by execution of the forced toner consumption process but deviates from the allowable range after repetitive execution of printing—forced toner consumption process.

To the contrary, when the threshold of the coverage rate is set in accordance with a carrier (carrier 3) which readily degrades the image quality, the threshold of the coverage rate is 3.0%. In the case, the frequency of the forced toner consumption process increases for a carrier (carrier 1) which hardly degrades the image quality, thus excessively consuming toner. To prevent an unnecessary increase in consumption amount while avoiding degradation of the image quality, the threshold of the coverage rate must be changed for each carrier in correspondence with variations in carrier characteristic.

If a threshold is held in the main body, it is difficult to change the threshold for each carrier (i.e., for each process cartridge). Therefore, it is preferable to store a proper threshold of the coverage rate for each carrier in the information storage medium of each process cartridge and use the information when the forced toner consumption mode is executed.

Figure 10:
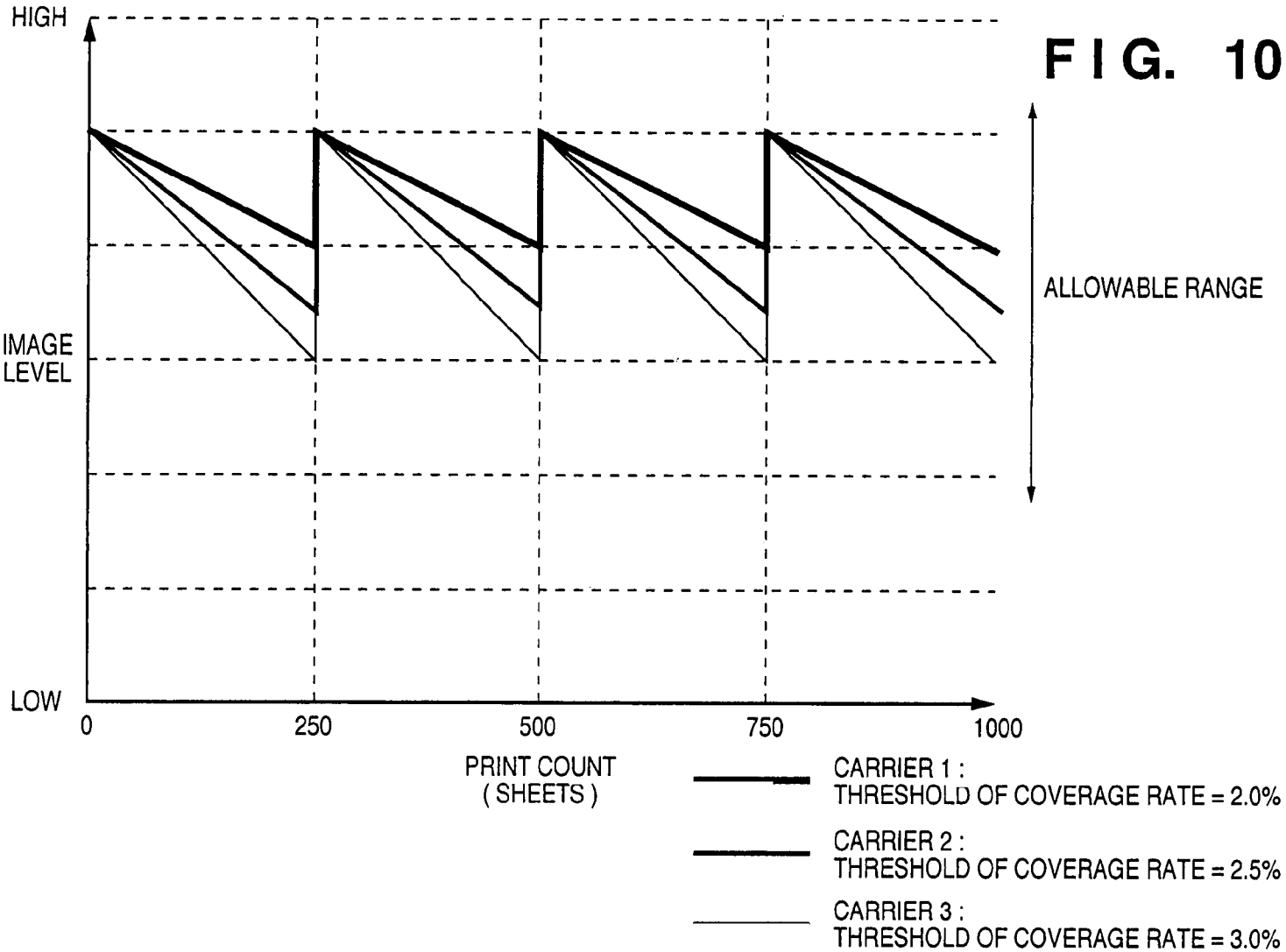
FIG. 10 is a graph showing the relationship between the print count and the image level when the threshold of the coverage rate is set for each carrier and forced toner consumption is performed in the first embodiment of the present invention.
Figure 11:
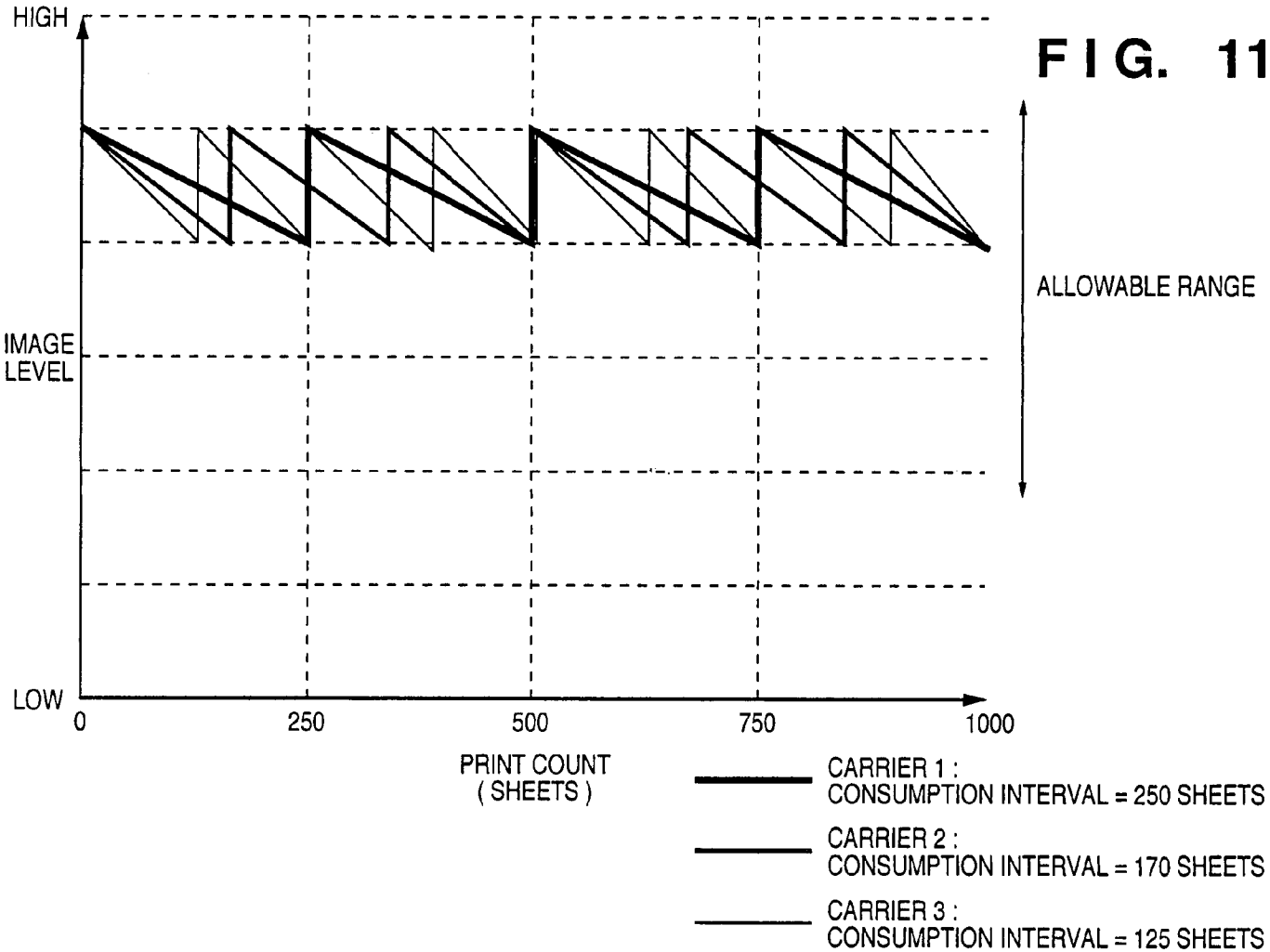
FIG. 11 is a graph showing the relationship between the print count and the image level when the consumption interval is set for each carrier and forced toner consumption is performed in the second embodiment of the present invention.

FIG. 10 shows transition of the image level when the threshold of the coverage rate is stored in the information storage medium of the cartridge for each carrier and forced toner consumption is done on the basis of the value. In this case, the threshold of the coverage rate is 2.0% for carrier 1, 2.5% for carrier 2, and 3.0% for carrier 3, and the forced toner consumption process is performed every 250 sheets. For each carrier, the image level changes within an appropriate range without exceeding the allowable range.

The forced toner consumption process in the first embodiment corresponding to the results of FIG. 10 will be described with reference to FIG. 4. When a print signal is input in step S401, a minimum coverage rate value (threshold of the coverage rate) which is stored in the information storage medium 400 of the process cartridge 10 of each station and is suitable for the process cartridge 10 is loaded to the main body in step S402.

When image formation actually starts in step S403, image data is loaded to calculate the video count in step S404. The video count is integrated into a value which is integrated in a main body ROM 34 in previous printing. The print count is also integrated into an integrated value stored in the main body ROM 34, and whether the integrated count is Np is determined. If the integrated count has not reached Np ("NO" in step S406), print operation continues in the same sequence until the print count reaches Np.

The print count Np corresponds to, e.g., 100 sheets or 250 sheets, but is not limited to them and may be set in accordance with the carrier characteristic of the process cartridge.

If the print count reaches Np ("YES" in step S406), the average coverage rate of each cartridge (print rate per 1 page) is calculated from the video count data and print count in step S407. For a cartridge in which the calculated value does not exceed the threshold of the coverage rate loaded from the cartridge ("YES" in step S407), toner is consumed in step S408 by the difference between the average coverage rate and the threshold of the coverage rate so that the average coverage rate coincides with the threshold of the coverage rate of the cartridge. For a cartridge in which the average coverage rate exceeds a predetermined value ("NO" in step S407), image formation continues without performing any forced toner consumption operation.

When the print count reaches Np, the print count in the main body ROM 34 is reset in step S409 for both a cartridge which has undergone forced toner consumption operation and a cartridge which does not undergo the operation. At this time, the integrated video count value is also reset. Thereafter, the print count is integrated up to Np, and whether to perform forced toner consumption operation is determined by calculation. By repetition of this sequence, an amount of toner is replaced preferably in accordance with the characteristic of carrier, and excessive rubbing of the same toner can be prevented. As a result, excessive charging and deterioration of toner can be suppressed, and degradation of the image quality can be prevented.

As described above, according to the first embodiment of the present invention, the process cartridge is equipped with the information storage medium. A proper threshold of the coverage rate for the carrier is stored in the information storage medium, and the forced toner consumption sequence is executed using the value. A coverage rate suitable for the process cartridge can always be maintained, and stable image formation can be achieved without excessively charging toner by carrier or deteriorating toner.

Second Embodiment

In the first embodiment, the threshold of the coverage rate is stored as information on forced toner consumption in the information storage medium 400 of the process cartridge. In the second embodiment, the print count is stored. In the second embodiment, the threshold of the coverage rate may be stored in a main body ROM 34 of an image forming apparatus main body. The image forming apparatus main body has the same arrangement as that in the first embodiment.

Figure 6:
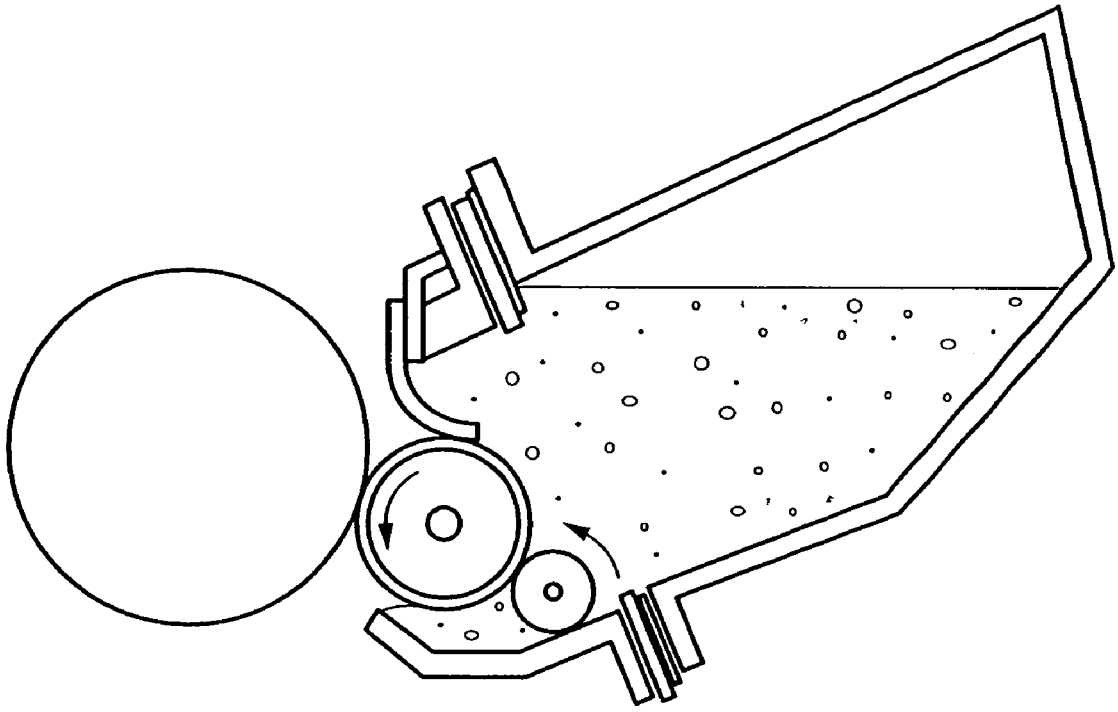
FIG. 6 is a sectional view showing an example of the arrangement of a developing unit in the conventional image forming apparatus.

In the image forming apparatus according to the second embodiment, the timing when forced toner consumption operation is executed can be delayed without changing the threshold for a carrier such as carrier 1 in FIG. 6 which can maintain the quality for a long time. Forced toner consumption operation can be done at an early timing for a carrier such as carrier 3 which readily degrades the image quality.

The timing when forced toner consumption operation is performed can be set to an appropriate value for each carrier. For example, the timing is set every 250 sheets for carrier 1, 170 sheets for carrier 2, and 125 sheets for carrier 3, and these values can be stored in the information storage medium 400 of the process cartridge 10. The threshold of the coverage rate may be fixed to, e.g., 2.0%, and the value is preferably stored in the main body ROM 34. With these settings, the image level changes within an allowable range at a high image level.

In this manner, the second embodiment executes the forced toner consumption process at a minimum time interval for each toner. The second embodiment can therefore solve the problem that the print speed decreases by unnecessarily performing forced toner consumption operation. The image quality can be stably maintained without excessively decreasing the print speed.

Third Embodiment

In the first and second embodiments, information on forced toner consumption is stored in the information storage medium 400 of the process cartridge 10. In the third embodiment, the information is stored in an information storage medium 500 of a toner cartridge 5. In the following description, the stored information is the threshold of the coverage rate, but the print count can also be stored. The arrangement of an image forming apparatus in the third embodiment is the same as that of the image forming apparatus in the first embodiment.

The arrangement of the information storage medium 500 is the same as that of the information storage medium described in the first embodiment. A predetermined storage area of the information storage medium 500 stores information on forced toner consumption.

Figure 12:
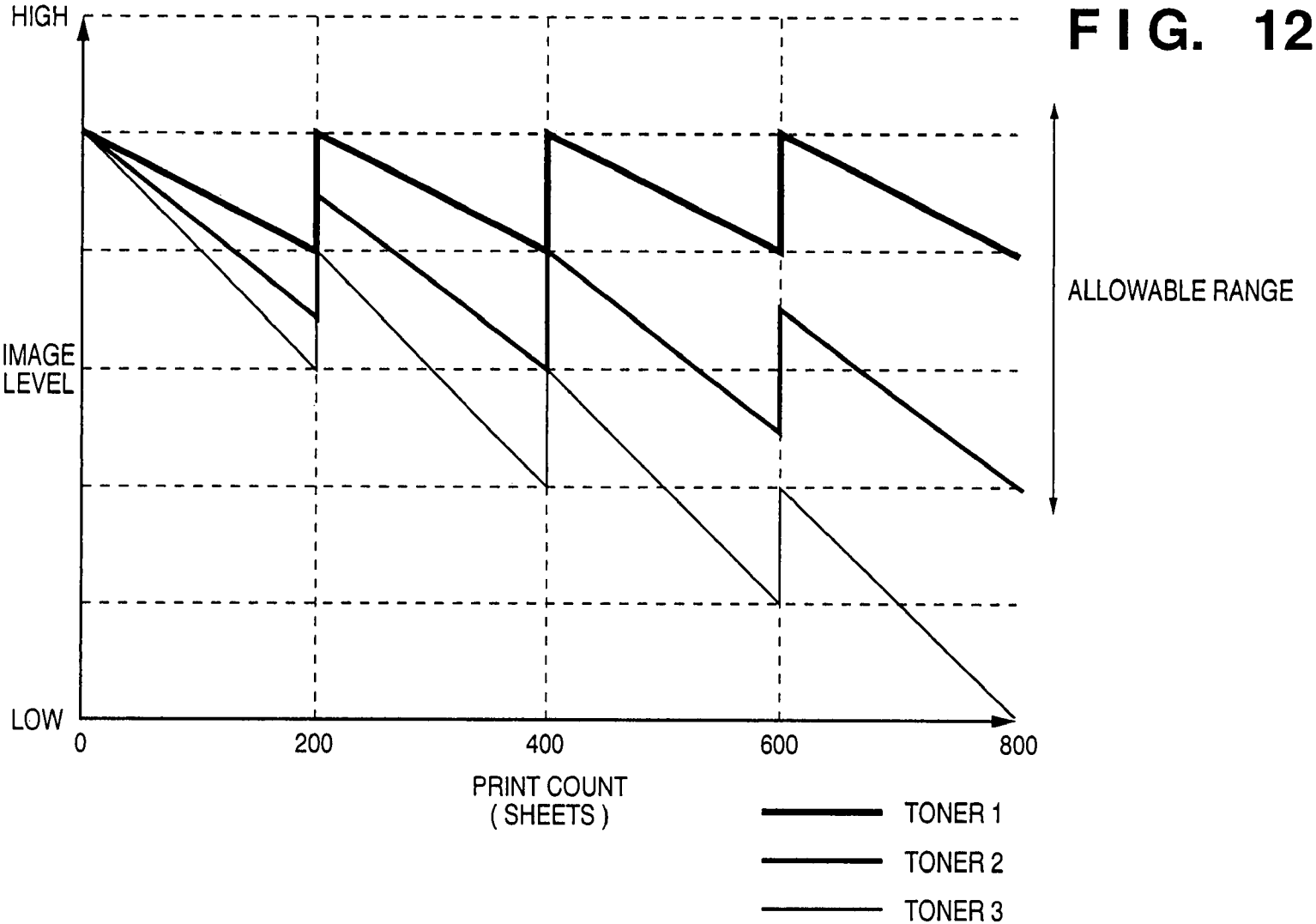
FIG. 12 is a graph showing the relationship between the print count and the image level when a predetermined number of images are successively printed without performing any forced toner consumption process in the third embodiment of the present invention.

The arrangement of the third embodiment according to the present invention will be explained in more detail. As shown in FIG. 12, three toners 1, 2, and 3 are different in the degradation degree of the image quality. If the forced toner consumption sequence is executed for these toners at the same threshold (2.0%) of the coverage rate and the same timing (every 200 sheets), the image level drops owing to insufficient toner consumption. As for a toner exhibiting a high image level, it may be excessively consumed.

Figure 13:
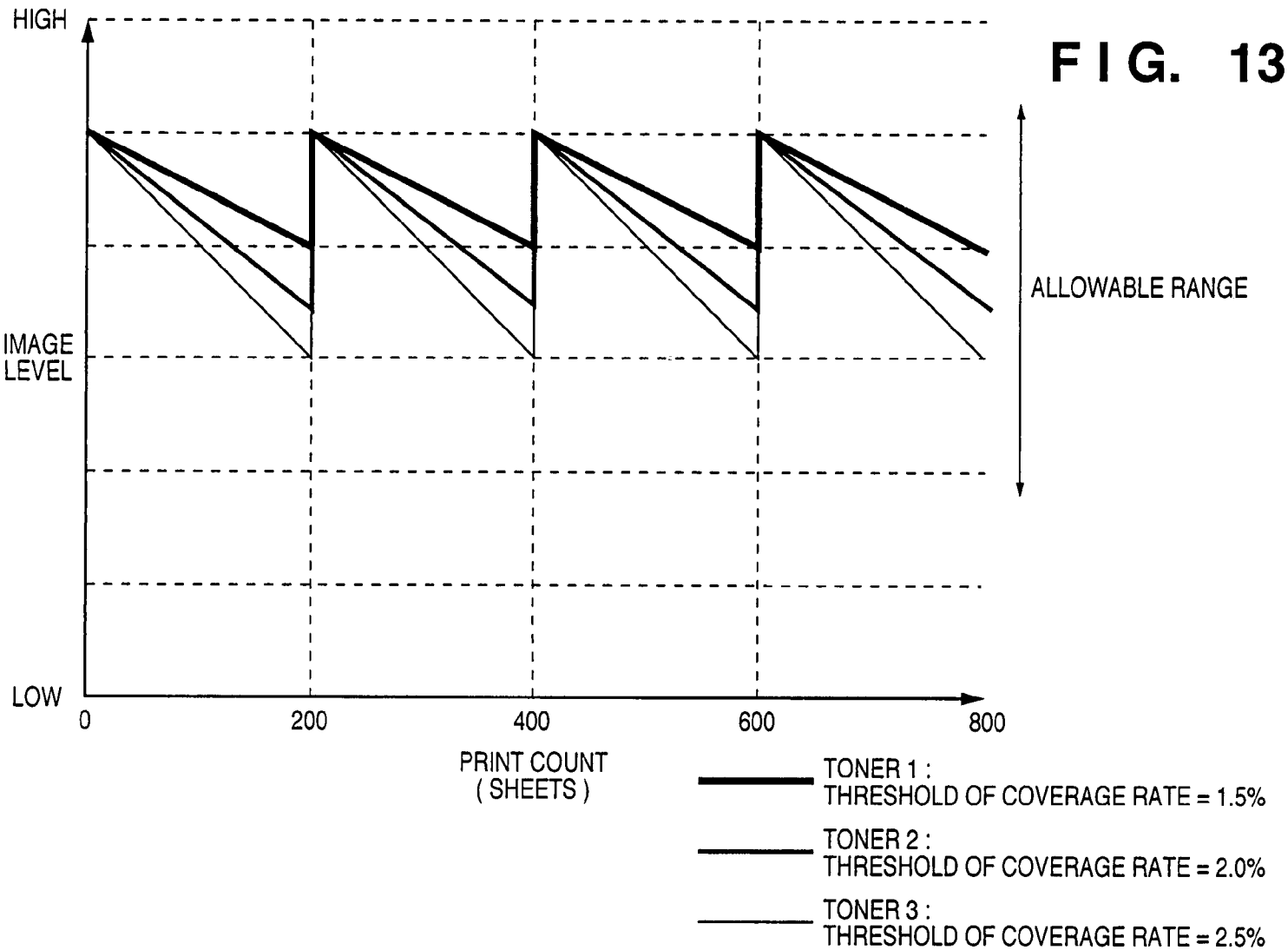
FIG. 13 is a graph showing the relationship between the print count and the image level when forced toner consumption is executed at the same timing by the same amount in the third embodiment of the present invention.

To prevent this, the third embodiment sets a proper threshold of the coverage rate for each toner. In this case, the threshold of the coverage rate is 1.5% for toner 1, 2.0% for toner 2, and 2.5% for toner 3, and these values are stored in the information storage medium 500 arranged in the toner cartridge. This can prevent a decrease in image level without wastefully consuming toner, as shown in FIG. 13. A sequence of forced toner consumption operation according to this embodiment is the same as the first embodiment (FIG. 4) and a detailed description of it is omitted.

Figure 14:
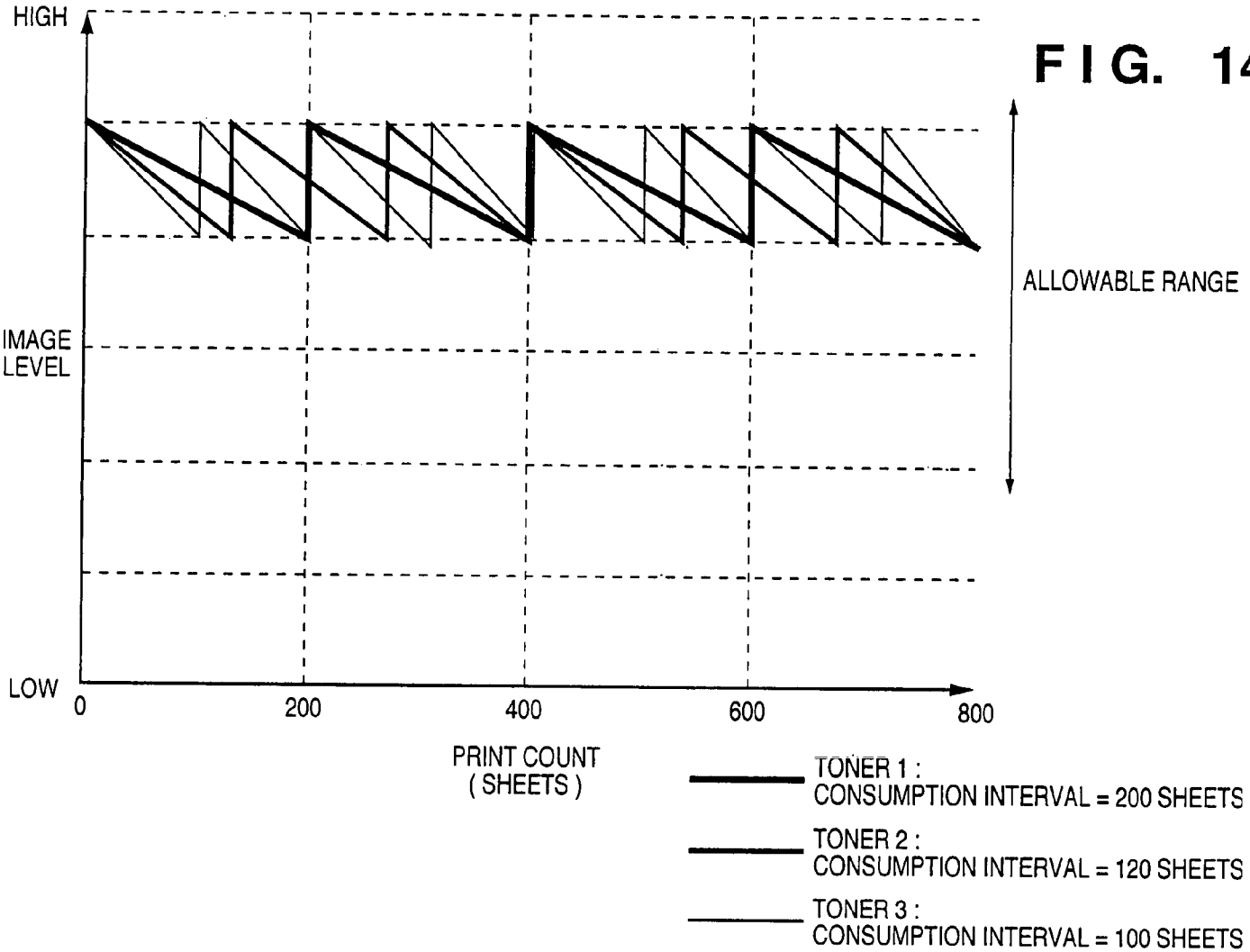
FIG. 14 is a graph showing the relationship between the print count and the image level when the consumption interval is set for each toner and forced toner consumption is performed in the first embodiment of the present invention.

The threshold of the coverage rate is stored in the information storage medium 500 of the toner cartridge. However, the same effects can also be obtained by storing an appropriate forced toner consumption operation timing (print count) for each toner, as shown in FIG. 14. The print count stored in the information storage medium 500 of the toner cartridge 5 which stores each toner can be set to, e.g., 200 sheets for toner 1, 120 sheets for toner 2, and 100 sheets for toner 3.

In this fashion, information on a proper forced consumption amount or the execution timing of forced consumption is stored in the information storage medium 500 of the toner cartridge 5 in accordance with toner. The third embodiment can cope with even a case in which toner rather than carrier influences toner deterioration or image deterioration caused by excessive charging.

As described above, information stored in the information storage medium of the toner cartridge is properly changed in accordance with the difference in characteristic due to variations in toner preparation conditions. A high-quality image can be formed without applying an unnecessary stress to the user, or wastefully consuming toner, unlike a case in which permanent information is stored in the image forming apparatus main body.

In the above embodiments, video count data and the print count for calculating an average coverage rate are stored in the main body ROM 34. These pieces of information can also be stored in the information storage medium of the cartridge. This realizes stabler image formation without causing any problem when the cartridge is used in another main body.

For example, when video count data and the print count are stored in the main body ROM 34 and the cartridge used is replaced with a different one, the process starts from the cumulative coverage rate and print count of the cartridge used before replacement, and toner may be wastefully consumed.

Even if information stored in the main body ROM 34 is reset upon replacement of the cartridge and the process starts from 0, the image quality may degrade because the previous use situation of a new cartridge is uncertain.

Hence, the cumulative coverage rate and print count are also desirably stored in the information storage medium of the cartridge.

Figure 4:
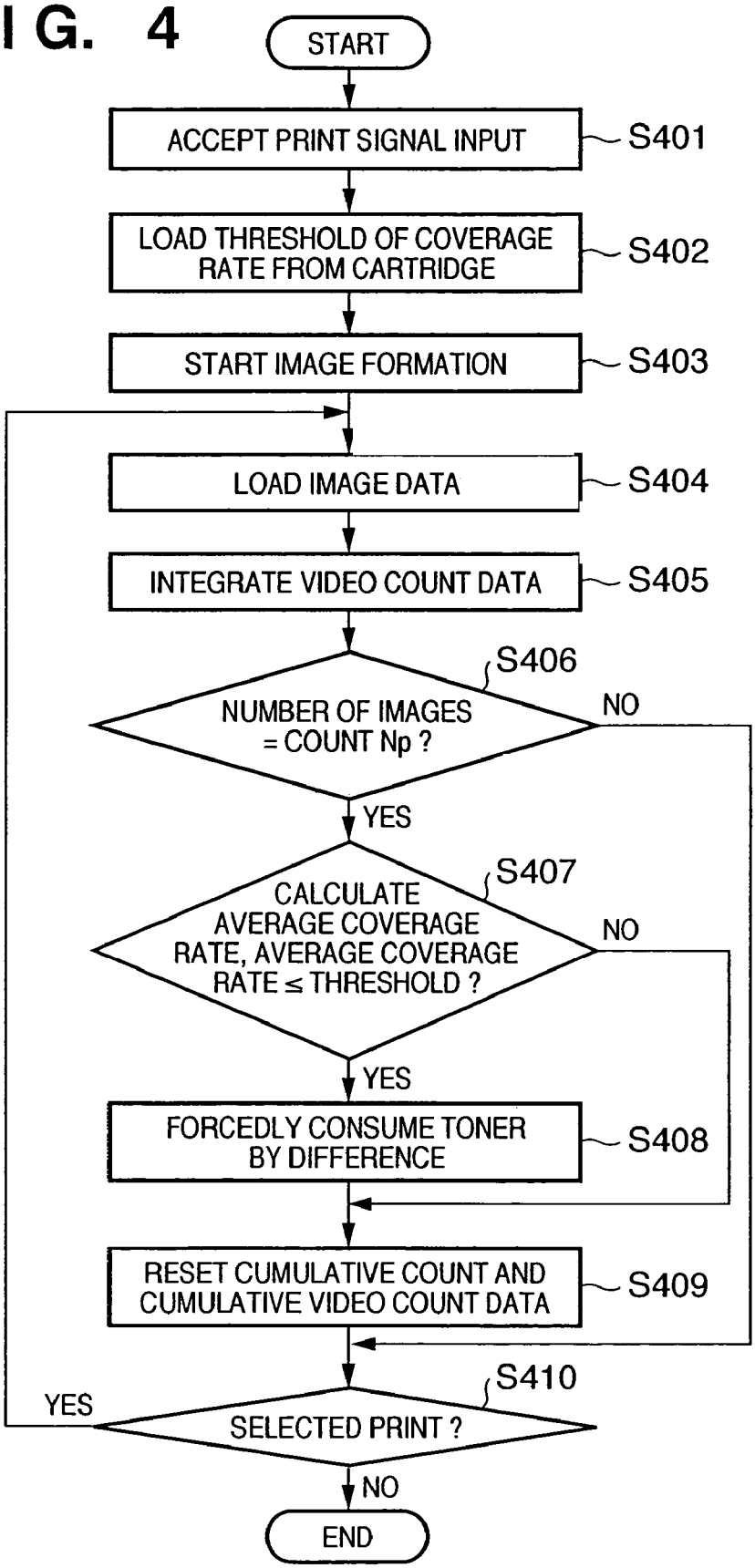
FIG. 4 is a flowchart corresponding to an example of a forced toner consumption process in the image forming apparatus according to the embodiment of the present invention.
Figure 5:
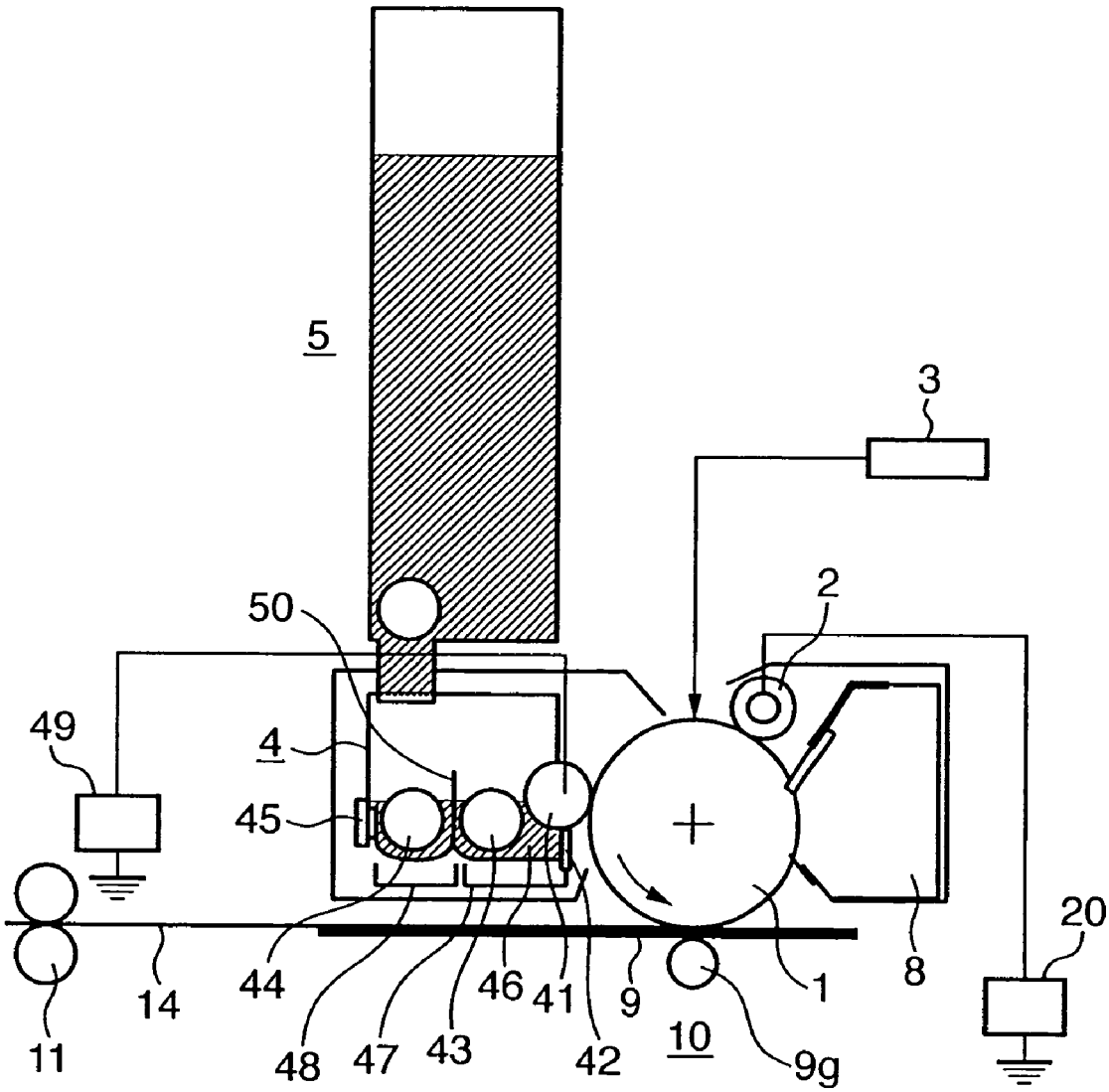
FIG. 5 is a sectional view showing an example of the arrangement of the conventional image forming apparatus.

In the first to third embodiments described above, the print count is a criterion according to which whether to perform forced toner consumption operation is determined (step S406 of FIG. 4). However, the criterion is not limited to this, and may be a value associated with the print count (e.g., the rotational speed of the sleeve, the rotational speed of the screw, or the rotational speed of the drum).

In the above embodiments, a method of storing information on forced toner consumption in the information storage medium of the toner cartridge 5 and a method of storing the information in the information storage medium of the process cartridge 10 have been described as separate embodiments. These methods can be adopted at the same time. In this case, an advantageous one of the coverage rate and operation interval is desirably selected against deterioration or excessive charging of toner so as not to deteriorate an image. A proper amount and timing can also be calculated from these pieces of information.

In the embodiments, whether to execute forced toner consumption operation every predetermined print count is determined. Alternatively, the forced toner consumption process is executed after image formation within a predetermined print count. This can eliminate the influence on an actual print process and prevent deterioration and excessive charging of toner without decreasing the print speed.

As described above, according to the embodiments of the present invention, a storage unit is arranged in a detachable unit such as a developing cartridge, and stores information on forced toner consumption operation. Appropriate information on forced consumption operation of the developer can therefore be provided in accordance with the difference in characteristic due to preparation variations in developer.

Also, the storage unit of the cartridge can store proper information on forced toner consumption operation in accordance with the difference in the characteristic of a member used for the developing unit. For this reason, images can be stably formed for a long time without excessively consuming toner or causing image deterioration by insufficient consumption. The fourth embodiment can be applied to a system using a two-component developer of toner and carrier as a developer and a system using a monocomponent developer of toner.

Fourth Embodiment

Figure 7:
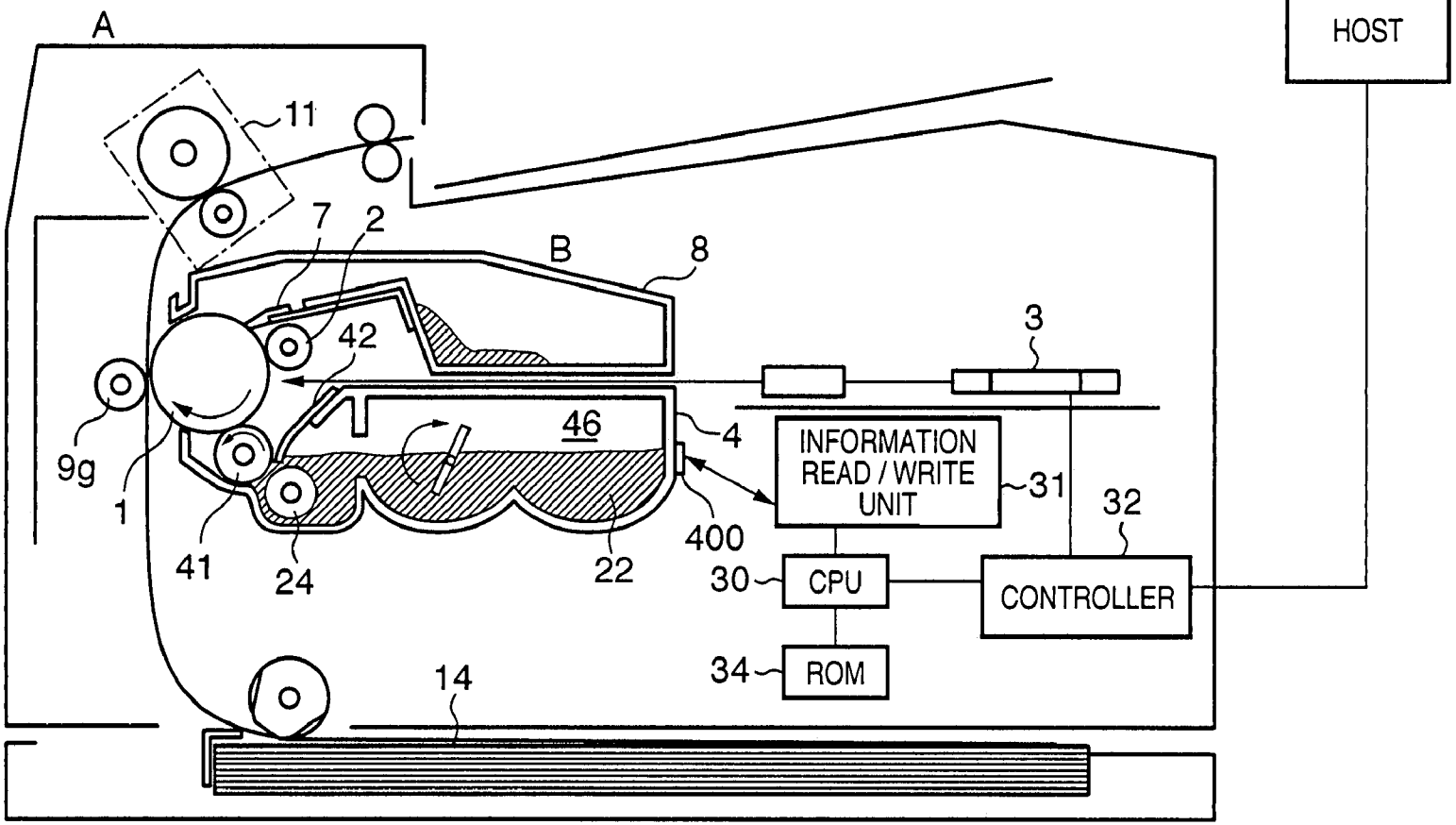
FIG. 7 is a sectional view showing an example of the arrangement of an image forming apparatus A according to the fourth embodiment of the present invention.

FIG. 7 is a schematic sectional view showing the fourth embodiment of an image forming apparatus according to the present invention. An image forming apparatus A according to the fourth embodiment is a laser beam printer which forms an image on a print medium 14 such as a print sheet or OHP sheet by electrophotography in accordance with image information. As will be described in detail later, a process cartridge B is detachable from the image forming apparatus A of the fourth embodiment.

The image forming apparatus A is used in connection with a host 33 such as a personal computer. A controller 32 processes a print request signal and image data from the host 33, controls an exposure device 3, and forms an electrostatic latent image on an image carrier 1.

The photosensitive drum 1 is uniformly charged by a roller-shaped charging member, i.e., DC contact charging roller (charging roller) 2 which is in press contact with the photosensitive drum 1. The charging roller 2 receives from a power supply 20 a DC voltage which is fixed to a predetermined value as a charge bias. The charging roller 2 then uniformly negatively charges the surface of the photosensitive drum 1. The charging roller 2 is driven and rotated in a direction indicated by an arrow R4 in FIG. 7 upon rotation of the photosensitive drum 1. The charging roller 2 abuts against almost the entire region of the photosensitive drum 1 in the longitudinal direction (direction perpendicular to the convey direction of the print medium 14).

The uniformly charged photosensitive drum 1 is exposed with a laser beam L from the exposure device 3 to form an electrostatic latent image on the surface of the drum 1. The exposure device 3 has a laser beam source, polygon mirror, lens system, and the like. The exposure device 3 can scan and expose the surface of the photosensitive drum 1 under the control of the controller.

The electrostatic latent image is visualized as a toner image by supplying a developer from a developing device 4. The developing device 4 comprises a developing vessel 46 which stores a negatively charged nonmagnetic toner (toner) 22 as a monocomponent developer. The fourth embodiment employs an almost spherical toner with a weighted mean grain diameter of about 7 μm in order to achieve a small grain diameter and low melting point and increase the transfer efficiency.

Part of the developing vessel 46 facing the photosensitive drum 1 is open in almost the entire region of the photosensitive drum 1 in the longitudinal direction. A developing roller 41 serving as a roller-shaped developer carrier (developing unit) is arranged in the opening. The developing roller 41 is brought by a predetermined intrusion amount into press contact with the photosensitive drum 1 positioned left above the developing device 4 in FIG. 7. The developing roller 41 is then rotated and driven. The surface of the developing roller 41 is properly rugged, in order to increase the rubbing efficiency with respect to the toner 22 and properly supply the toner 22.

An elastic roller 24 abuts against a lower right portion of the developing roller 41 in FIG. 7, as a unit which supplies the developer to the developing roller 41 and removes undeveloped toner from the developing roller 41. The elastic roller 24 is rotatably supported by the developing vessel 46. The elastic roller 24 is a rubber sponge roller in consideration of supply of toner to the developing roller 41 and removal of undeveloped toner. The elastic roller 24 is rotated and driven in the same direction as that of the developing roller 41.

The developing device 4 comprises a developing blade 42 as a developer layer thickness regulating member which regulates a toner amount carried by the developing roller 41. The developing blade 42 is formed by an elastic metal thin plate of phosphor bronze. The tip of the free end of the developing blade 42 abuts in surface contact against the peripheral surface of the developing roller 41. Toner which is carried on the developing roller 41 upon rubbing by the elastic roller 24 is charged by triboelectrification and regulated to a thin layer when passing through the abutment portion against the developing blade 42.

In the developing device 4 having this arrangement, the developing roller 41 receives a DC voltage fixed to a predetermined value as a developing bias. In the fourth embodiment, an exposed portion at which the negative charges have attenuated on the surface of the uniformly charged photosensitive drum 1 is developed by reversal development.

The print medium 14 is separated and fed from a print medium storage by a supply roller or the like, and temporarily stopped by a registration roller. The registration roller synchronizes the print position of the print medium and the formation timing of a toner image on the photosensitive drum 1. The registration roller feeds the print medium 14 to a portion (transfer portion) at which a transfer roller 9*g* serving as a transfer unit and the photosensitive drum 1 face each other.

A visualized toner image on the photosensitive drum 1 is transferred to the print medium 14 by the operation of the transfer roller 9*g*. The print medium 14 bearing the toner image is conveyed to a fixing device 12 where the unfixed toner image on the print medium 14 is permanently fixed onto the print medium 14 by heat or pressure. After that, the print medium 14 is delivered outside the apparatus by a discharge roller or the like.

Toner which is not transferred and remains on the photosensitive drum 1 after transfer is cleaned by a cleaning unit (cleaner) 8. The cleaner 8 scrapes the remaining toner from the photosensitive drum 1 by a cleaning blade 7 serving as a cleaning member, and stores the scraped toner in a waste toner vessel. The cleaned photosensitive drum 1 is then used for image formation.

According to the fourth embodiment, the image forming apparatus A employs a process cartridge method in which an image carrier having an electrophotographic photosensitive body and a process unit acting on the image carrier are integrated into a cartridge and the cartridge is detachable from the apparatus main body. As the process cartridge, the photosensitive drum 1, charging roller 2, developing device 4, and cleaner 8 are integrated into the process cartridge B which is detachable from the main body of the image forming apparatus A. The process cartridge B is detachably mounted on the apparatus main body via the mounting unit of the image forming apparatus A.

According to the fourth embodiment, the process cartridge B comprises an information storage medium 400. The information storage medium 400 can take an arbitrary form: a contact nonvolatile memory which performs communication by contact via a connector (not shown), a contact (not shown), or the like, a noncontact nonvolatile memory, or a volatile memory having a power supply. In the fourth embodiment, a noncontact nonvolatile memory is mounted as an information storage medium in the process cartridge B.

The noncontact nonvolatile memory has an antenna (not shown) serving as an information transmission unit on the memory side. The memory communicates with a control unit (CPU) 30 of the image forming apparatus main body by wireless communication using the antenna, thereby reading out and writing information. In the fourth embodiment, the CPU 30 comprises an information read/write unit 31 as an information communication unit on the apparatus main body side. The information read/write unit 31 has the function of an information read/write unit for the memory 400.

Note that a memory 26 is identical to the information storage medium described in the first embodiment. A predetermined storage area of the memory 26 (storage medium) stores information on forced toner consumption.

When many low-coverage-rate images are printed with the process cartridge B using the developing unit of the above-described arrangement, toner near the developing roller 41 and elastic roller 24 is hardly replaced, and toner deteriorates, resulting in image degradation such as transfer nonuniformity or a low density. Toner deterioration occurs mainly due to rubbing between the developing roller 41 and the developing blade 42. From this, degradation of the image quality is prevented by forcedly consuming, by forced toner consumption operation, toner which deteriorates upon rubbing and replacing the toner with fresh one which has not been rubbed yet.

In the fourth embodiment, forced toner consumption operation was executed as follows. Let T be the number of turns of the developing roller 41 necessary to form an A4-size image. A primary charge bias of −650 V was applied every 100T of the developing roller 41 corresponding to 100 sheets, thereby setting the surface potential of the photosensitive drum 1 to an exposure potential. In a non-image formation state (in backward rotation or forward rotation or between paper sheets), deteriorated toner was supplied onto the photosensitive drum 1 by an amount corresponding to one page of a solid black image. Accordingly, deteriorated toner was forcedly consumed to reduce degradation of the image quality along with an increase in the number of formed images.

However, the toner deterioration level varies depending on the characteristic of toner used. The number of turns of the developing roller was set to 100T for normal toner B. For toner A which hardly deteriorates, the image quality did not degrade at the number of turns of the roller=100T, and no image error occurred up to 150T. To the contrary, for toner C which readily deteriorates, consumption of toner by an amount corresponding to one page of a solid black image every 100T was not sufficient, and a forced toner consumption amount 1.5 times larger than a normal amount was required every 100T. Alternatively, a normal amount of toner must be consumed every 70T.

As described above, the toner deterioration level is different between toner lots or the like. When a ROM 34 of the image forming apparatus A stores a predetermined consumption amount and the threshold of the number of turns of the developing roller, toner is wastefully consumed or forced toner consumption operation is unnecessarily executed, decreasing the print speed. If the consumption amount is decreased or the execution interval is prolonged to prevent these problems, an image may deteriorate due to an insufficient toner consumption amount by a combination of key parts and toner prone to deteriorate.

To prevent this, according to the fourth embodiment, the information storage medium of the cartridge stores for each toner the number of turns of the developing roller by which forced toner consumption operation is performed. The number of turns is 150T for toner A, 100T for toner B, and 70T for toner C. A high-quality image can be stably provided by storing information (the number of turns of the developing roller by which forced toner consumption is performed) on the timing when forced toner consumption appropriate for each process cartridge is executed. This is because variations in toner deterioration level between toners can be coped with.

Since information on forced toner consumption is stored in the information storage medium 400 of the process cartridge B and utilized, not only the above-mentioned variations in toner but also variations in member such as the developing roller 41 or developing blade 42 can also be dealt with.

The fourth embodiment executes forced toner consumption operation during a continuous print job. Alternatively, the operation can be done after the end of continuous printing as far as the number of turns of the developing roller does not exceed the threshold. In this case, the same effects as those of the fourth embodiment can be attained without decreasing the speed of continuous printing.

In the fourth embodiment, the surface potential of the photosensitive drum 1 is set to an exposure potential by the primary charge bias in development onto the photosensitive drum 1 in a state (non-image formation state) except an image formation state. Consequently, development can be done without deteriorating the surface of the photosensitive drum 1 by discharge of primary charging. However, the present invention is not limited to this aspect. The principle of the present invention can also be applied to a case in which development is performed in a state except an image formation state by exposing the photosensitive drum 1. Also at this time, the same effects as those of the fourth embodiment can be obtained.

The fourth embodiment employs contact development, but the present invention is not limited to this. The present invention is effective in an image forming apparatus in which toner is rubbed in a development process, for example, in noncontact jumping development using a toner supply roller, elastic regulating blade, and the like.

Fifth Embodiment

In the first to fourth embodiments, forced toner consumption operation is executed when the coverage rate falls below the threshold at a predetermined print count. In the fifth embodiment, the difference between an actually consumed toner amount and the minimum toner consumption amount for keeping a high image quality with respect to the print count serving as the use amount of the developing device is confirmed. When the difference reaches a predetermined value ΔX, forced toner consumption is executed. The toner consumption amount is calculated from information on the coverage rate or the like, instead of directly confirming the toner amount.

An image forming apparatus according to the fifth embodiment has the same arrangement as that in FIGS. 1 and 2 described in the first embodiment. The relationship between the image forming apparatus main body and an information storage medium serving as a nonvolatile memory arranged in the process cartridge is also the same as the arrangement in the block diagram of FIG. 15. Thus, a description of the image forming apparatus and the relationship between the image forming apparatus main body and the information storage medium will be omitted.

In this case, the minimum toner consumption amount for keeping a high image quality with respect to the print count is defined as the product of the print count and the minimum coverage rate (threshold of the coverage rate) for keeping a high-quality image. The image forming apparatus main body has the same arrangement as that in the first embodiment. In the fifth embodiment, the predetermined value ΔX and the threshold of the coverage rate are stored in the information storage medium of the process cartridge (the predetermined value ΔX and the threshold of the coverage rate are stored as information for controlling forced toner consumption operation).

According to the method of the fifth embodiment, forced toner consumption operation can be done in accordance with the coverage rate only after no high-quality image can be obtained, instead of always performing forced toner consumption operation every predetermined print count when the coverage rate is equal to or lower than the threshold regardless of the value of the coverage rate. That is, even if low-coverage-rate images continue, forced toner consumption operation can wait until image degradation appears. When a high-coverage-rate image is subsequently printed, the image quality can be recovered from the degradation without executing any forced toner consumption operation. This can reduce the stress on the user caused by frequent control every predetermined print count as described in the first embodiment, and also suppress the waste of toner.

Figure 16:
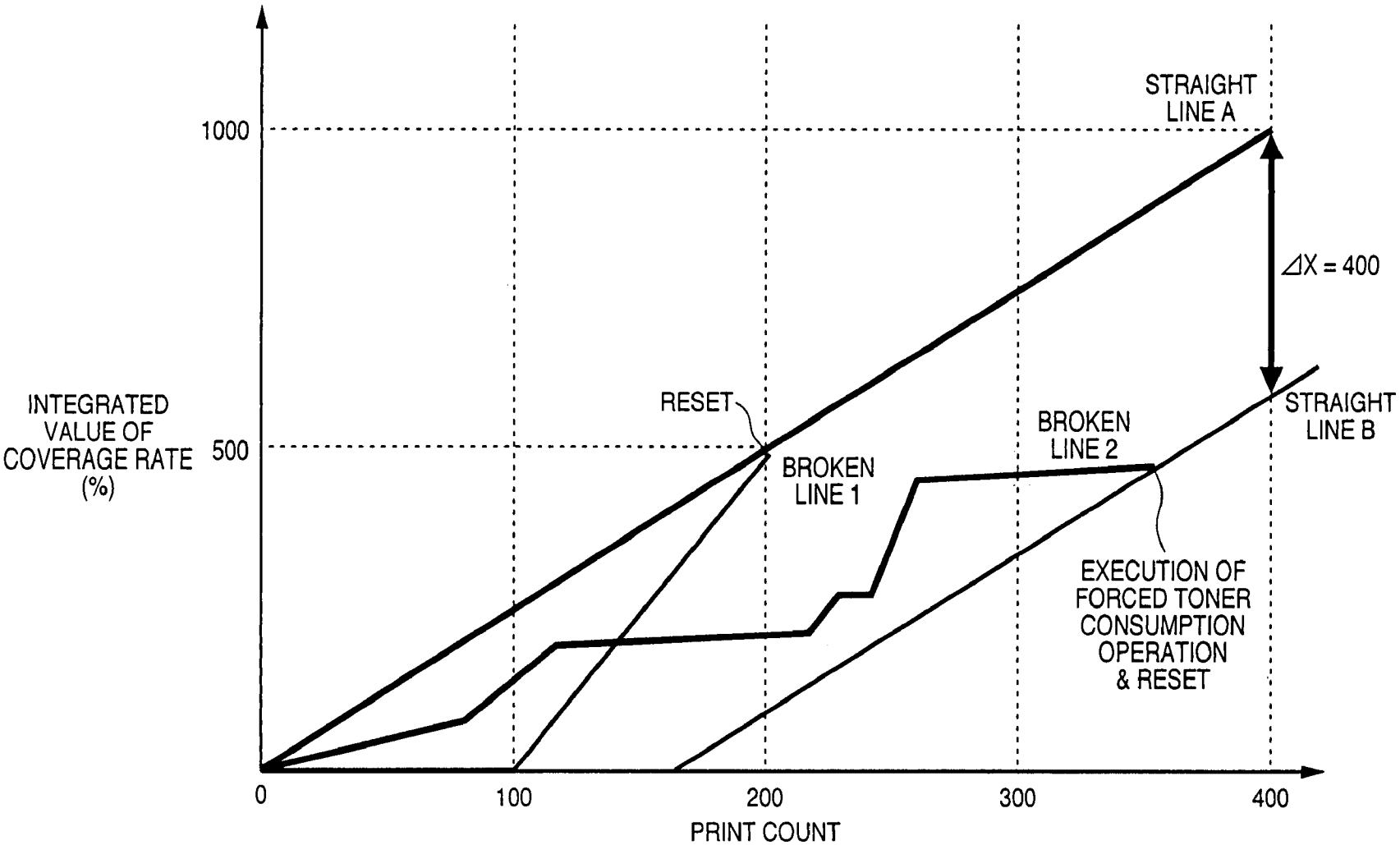
FIG. 16 is a graph showing the relationship between the print count and the integrated value of the coverage rate in the fifth embodiment of the present invention.

A forced toner consumption method according to the fifth embodiment will be described with reference to FIG. 16. FIG. 16 shows the relationship between the print count and the integrated value of the coverage rate.

With toner, carrier, and the developer arrangement used in the fifth embodiment, the threshold of the coverage rate at which no image degradation occurred was 2.5%. Straight line A in FIG. 16 represents the integrated value of the coverage rate in printing at a coverage rate of 2.5%. Letting R be the integrated value of the coverage rate, straight line A is expressed by multiplication of a print count P and the coverage rate (2.5%):

$$R=2.5\cdot P \tag{1}$$

Straight line B represents the integrated value of the coverage rate when the predetermined value AX is subtracted from straight line A. Straight line B is given by $$R=2.5\cdot P-\Delta X \tag{2}$$

In the fifth embodiment, the number of images which could be printed without any image error at a coverage rate of 0.5% was 200, and thus ΔX was set to execute forced toner consumption. In this case, ΔX=400%. Forced toner consumption is executed when the integrated value of the coverage rate in actual printing falls below straight line B. After forced toner consumption is executed, the print count and the integrated value of the coverage rate are reset. When the integrated value of the coverage rate exceeds straight line A, the print count and the integrated value of the coverage rate are only reset.

Broken lines 1 and 2 in FIG. 16 represent integrated values of the coverage rate in actual printing. Broken line 1 shows the relationship between the print count and the integrated value of the coverage rate when the coverage rate is 0% for the first 100 images and then 5.0%. At this time, the integrated value of the coverage rate exceeds straight line A at a print count of 200, and the print count and the integrated value of the coverage rate are reset. Broken line 2 shows the relationship between the print count and the integrated value of the coverage rate when images with various coverage rates are output. The integrated value of the coverage rate finally falls below straight line B at a print count of 350. The forced toner consumption sequence is executed, and the print count and the integrated value of the coverage rate are reset.

In this manner, the developer can be maintained in a good state without performing any forced toner consumption operation when the coverage rate is 0% but a high-coverage-rate image is subsequently printed. When 100 images are printed at a coverage rate of 0%, no image error occurs. Forced toner consumption operation can wait until no high-quality image can be obtained, as far as high-coverage-rate printing and low-coverage-rate printing are repeated. The timing when forced toner consumption operation is executed can be delayed, decreasing the number of forced toner consumption operations. Also in this case, no image error occurred. However, if low-coverage-rate printing continued without executing forced toner consumption at a print count of 350, the density decreased several images after 350 images, and an image error occurred.

In the fifth embodiment, the difference between an actually consumed toner amount and the minimum toner consumption amount for keeping a high image quality with respect to the print count is confirmed. When the difference reaches a predetermined value, forced toner consumption is executed. The fifth embodiment can suppress a decrease in print speed and the waste of toner which are caused by unnecessarily executing forced toner consumption operation. In addition, the fifth embodiment can stably form a high-quality image.

In the fifth embodiment, the threshold of the coverage rate and the difference $\Delta X$ are stored in the storage unit of the process cartridge. Since the threshold of the coverage rate and the difference $\Delta X$ can be changed in accordance with the toner or carrier characteristic, forced toner consumption corresponding to each toner or carrier can be performed. No toner is wasted, or the prolongation of the print time owing to frequent control can be suppressed.

In order to minimize the stored information amount, the minimum toner consumption amount (integrated value of the coverage rate) for keeping a high-quality image is calculated by multiplying the threshold of the coverage rate and the print count. It is also possible to prepare a table with which the minimum toner consumption amount for keeping a high-quality image is uniquely determined in accordance with the print count, and control forced toner consumption operation from a value in the table.

The fifth embodiment has described a case in which the print count is employed as the use amount of the developing device. The use amount of the developing device is not limited to the print count, and may be the number of turns of the developer carrier or the driving time of the developer carrier.

Control in the fifth embodiment is executed by a program (not shown) stored in the CPU 30 of FIG. 2.

When the characteristic of toner, carrier, or the like hardly changes and is stable, the threshold of the coverage rate and the difference $\Delta X$ can be stored in the storage unit of the image forming apparatus main body, in place of the storage unit of the process cartridge.

The fifth embodiment can be applied to a system using a two-component developer of toner and carrier as a developer and a system using a monocomponent developer of toner.

As has been described above, the present invention can prevent excessive toner consumption and image deterioration due to insufficient consumption in forced toner consumption operation by reducing the influence of variations in developer and the characteristics of parts for each unit. As a result, a high-quality image output can be stably obtained for a long time.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priorities from Japanese Patent Application No. 2003-204820 filed on Jul. 31, 2003 and Japanese Patent Application No. 2004-207605 filed on Jul. 14, 2004, which are hereby incorporated by reference herein.

What is claimed is:

1. An image forming apparatus which forms an image by using a unit including a member associated with image formation and a storage portion storing information, the apparatus comprising:

an image carrier;

a developing unit for developing a latent image formed on said image carrier by supplying toner to said image carrier; and a controller for controlling a toner consumption operation without printing any image on a print medium, wherein said storage portion stores a control information according to a kind of the toner, and wherein said controller determines a timing to execute the toner consumption operation or whether or not to execute the toner consumption operation, based on the control information stored in said storage operation.

2. The apparatus according to claim 1, wherein the control information includes an image coverage rate according to the kind of the toner, and wherein said controller determines whether or not to execute the toner consumption operation based on the image coverage rate.

3. The apparatus according to claim 1, wherein said member associated with image formation includes said image carrier, a charging unit for charging said image carrier, or said developing unit.

4. The apparatus according to claim 1, wherein the control information includes a print count according to the kind of the toner or a driving amount of said developing unit accord to the kind of the toner, and wherein said controller determines a timing to execute the toner consumption operation based on the print count or the driving amount.

5. An image forming apparatus which forms an image by using a unit including a member associated with image formation and a storage portion storing information, the apparatus comprising:

an image carrier;

a developing unit, including a developer containing toner and carrier, for developing a latent image formed on said image carrier by supplying the toner to said image carrier; and a controller for controlling toner consumption operation without printing any image on a print medium, wherein said storage portion stores a control information according to a kind of the carrier, and wherein said controller determines a timing to execute the toner consumption operation or whether or not to execute the toner consumption operation, based on the control information stored in said storage portion.

6. The apparatus according to claim 5, wherein the information includes an image coverage rate according to the kind of the carrier, and wherein said controller determines whether or not to execute the toner consumption operation based on the image coverage rate.

7. The apparatus according to claim 5, wherein said member associated with image formation includes said image carrier, a charging unit for charging said image carrier, or said developing unit.

8. The apparatus according to claim 5, wherein the control information includes a print count according to the kind of the carrier, and said controller determines a timing to execute the toner consumption operation based on the print count.

9. A unit detachable from an image forming apparatus having a developer consumption mode in which developer is consumed without printing any image on a print medium, the unit comprising:

a member associated with image formation; and a storage unit having a storage area which stores a control information according to a kind of the developer, and wherein said control information is used to determine a timing to execute the developer consumption operation or whether or not to execute the developer consumption operation.

10. The unit according to claim 9, wherein said developer includes toner and carrier, and wherein the control information includes any one of an image coverage rate according to a kind of the toner or a kind of carrier, a print count according to the kind of the toner or the kind of the carrier, and a driving amount of developing unit according to the kind of the toner.

11. The unit according to claim 9, wherein the unit further comprises a container for containing at least the toner.

12. The unit according to claim 9, wherein said member associated with image formation includes an image carrier, a charging unit for charging the image carrier, and a developing unit for developing an electrostatic latent image on the image carrier, and wherein the unit includes the image carrier, the developing unit, and the charging unit.

13. A storage medium which is mounted in a unit used in an image forming apparatus operable in developer consumption mode in which developer is consumed without printing any image on a print medium, wherein the image forming apparatus comprises an image carrier, charging unit for charging a surface of the image carrier, and developing unit for developing a latent image formed on the image carrier by supplying the developer, wherein the storage medium has a storage area which stores control information according to a kind of the developer, and wherein the control information is used to determine a timing to execute the developer consumption operation or whether or not to execute the developer consumption operation.

14. The medium according to claim 13, wherein said developer includes toner and carrier, and the control information includes any one of an image coverage rate according to a kind of the toner or a kind of the carrier, a print count according to the kind of the toner or the kind of the carrier, and a driving amount of the developing unit according to the kind of the toner.

15. An image forming apparatus comprising:

an image carrier;

a developing unit for developing a latent image formed on said image carrier by supplying toner; and a controller for controlling toner consumption operation of consuming the toner without printing any image on a print medium, wherein said controller determines whether a consumption amount of the toner obtained based on an image coverage rate and a print count, fall within a certain range and if not, executes the toner consumption operation.

16. The apparatus according to claim 15, wherein the certain range is a range having maximum and minimum values associated with the consumption amount of the toner, and said controller executes the toner consumption operation when the consumption amount of the toner is less than the minimum value.

17. The apparatus according to claim 16, wherein said controller resets the image coverage rate and the print count, when the consumption amount of the toner is more than the maximum value.

* * * * *

UNITED STATES PATENT AND TRADEMARK OFFICE

CERTIFICATE OF CORRECTION

PATENT NO. : 7,095,966 B2
APPLICATION NO. : 10/896898
DATED : August 22, 2006
INVENTOR(S) : Motoki Adachi It is certified that error appears in the above-identified patent and that said Letters Patent is hereby corrected as shown below:

COLUMN 4:
Line 36, “and” should be deleted.
Line 40, “invention.” should read --invention; and--.

COLUMN 16:
Line 48, “AX” should read --ΔX--.

COLUMN 18:
Line 40, “operation.” should read --portion.--.
Line 54, “accord” should read --according--.

COLUMN 19:
Line 1, “controlling” should read --controlling a--.
Line 25, “consumption” should read --consumption operation--.
Line 30, “developer, and” should read --developer,--.

COLUMN 20:
Line 2, “in” should read --in a--.
Line 3, “tion” should read --tion operation--.
Line 6, “carrier,” should read --carrier, a--.
Line 7, “and” should read --and a--.
Line 30, “controlling” should read --controlling a--.
Line 34, “toner” should read --toner,--.
Line 35, “fall” should read --falls--.

Signed and Sealed this

Seventeenth Day of April, 2007

JON W. DUDAS
*Director of the United States Patent and Trademark Office*